US010426249B2

(12) United States Patent
Hohlbein et al.

(10) Patent No.: US 10,426,249 B2
(45) Date of Patent: Oct. 1, 2019

(54) ORAL CARE IMPLEMENT

(71) Applicant: COLGATE-PALMOLIVE COMPANY, New York, NY (US)

(72) Inventors: Douglas Joseph Hohlbein, Hopewell, NJ (US); Chi Shing Wong, Warren, NJ (US)

(73) Assignee: Colgate-Palmolive Company, New York, NY (US)

( * ) Notice: Subject to any disclaimer, the term of this patent is extended or adjusted under 35 U.S.C. 154(b) by 281 days.

(21) Appl. No.: 15/254,751

(22) Filed: Sep. 1, 2016

(65) Prior Publication Data

US 2018/0055208 A1 Mar. 1, 2018

(51) Int. Cl.

| | |
|---|---|
| ***A46B 9/04*** | (2006.01) |
| ***A46B 1/00*** | (2006.01) |
| ***A46B 9/02*** | (2006.01) |
| ***A46B 3/20*** | (2006.01) |
| ***A46D 1/00*** | (2006.01) |

(52) U.S. Cl.

CPC ..... *A46B 9/04* (2013.01); *A46B 1/00* (2013.01); *A46B 3/20* (2013.01); *A46B 9/028* (2013.01); *A46D 1/0207* (2013.01); *A46D 1/0238* (2013.01); *A46B 2200/1066* (2013.01)

(58) Field of Classification Search

USPC ..... 15/160, 167.1, 194, 201

See application file for complete search history.

(56) References Cited

U.S. PATENT DOCUMENTS

| | | | | |
|---|---|---|---|---|
| 668,361 | A * | 2/1901 | Tesch | A46B 7/04 15/176.3 |
| 1,415,760 | A | 5/1922 | Alles | |
| 2,164,219 | A | 6/1939 | McGerry | |
| 2,882,544 | A * | 4/1959 | Hadidian | A46B 5/0029 15/167.1 |
| 3,129,449 | A * | 4/1964 | Cyzer | A46B 7/06 15/28 |
| 3,263,258 | A | 8/1966 | Burge | |
| 4,694,844 | A | 9/1987 | Berl et al. | |
| 5,184,368 | A | 2/1993 | Holland | |

(Continued)

FOREIGN PATENT DOCUMENTS

| | | |
|---|---|---|
| DE | 42 07 968 | 9/1993 |
| EP | 0 923 327 | 4/2004 |

(Continued)

*Primary Examiner* — Joseph J Hail
*Assistant Examiner* — Shantese L McDonald

(57) ABSTRACT

An oral care implement that includes a handle and a head. A tuft of cleaning elements extends from the front surface of the head along an axis and includes a plurality of cleaning elements. In one embodiment, the cleaning elements may be formed of an elastomeric material. Furthermore, a sleeve may be coupled to the head and extend from the front surface of the head. The sleeve circumferentially surrounds a first portion of the tuft of cleaning elements and a second portion of the tuft of cleaning elements protrudes beyond a distal end of the sleeve. The sleeve may apply a radial compression force onto the first portions of the cleaning elements that are surrounded by the sleeves. The second portions of the cleaning elements may diverge as they extend from the distal end of the sleeve. The oral care implement may include sleeves of varying heights.

20 Claims, 14 Drawing Sheets

(56) References Cited

U.S. PATENT DOCUMENTS

| | | | | | |
|---|---|---|---|---|---|
| 5,345,645 | A * | 9/1994 | Page | A46B 9/04 | 15/160 |
| 5,524,319 | A | 6/1996 | Avidor | | |
| 5,546,626 | A | 8/1996 | Chung | | |
| 5,799,354 | A * | 9/1998 | Amir | A46B 5/0025 | 15/167.1 |
| 5,850,660 | A | 12/1998 | O'Halloran | | |
| 5,970,564 | A | 10/1999 | Inns et al. | | |
| 5,987,688 | A | 11/1999 | Roberts et al. | | |
| 5,991,959 | A | 11/1999 | Raven et al. | | |
| 6,067,684 | A | 5/2000 | Kweon | | |
| 6,163,918 | A | 12/2000 | Weihrauch | | |
| 6,311,360 | B1 * | 11/2001 | Lanvers | A46B 3/16 | 15/167.1 |
| 6,496,999 | B1 | 12/2002 | Gleason et al. | | |
| 6,497,458 | B2 | 12/2002 | Batson et al. | | |
| 8,488,286 | B2 | 5/2013 | Driesen et al. | | |
| 2002/0004964 | A1 * | 1/2002 | Luchino | A46B 3/00 | 15/167.1 |
| 2002/0189041 | A1 | 12/2002 | Duff et al. | | |
| 2004/0211018 | A1 | 10/2004 | Canton et al. | | |
| 2006/0019097 | A1 | 1/2006 | Weihrauch | | |
| 2009/0013488 | A1 | 1/2009 | Sakurai et al. | | |
| 2010/0017989 | A1 | 1/2010 | Kraemer | | |
| 2012/0167319 | A1 | 7/2012 | Quigley et al. | | |
| 2012/0271474 | A1 | 10/2012 | Yoneda et al. | | |

FOREIGN PATENT DOCUMENTS

| | | |
|---|---|---|
| JP | H10-57146 | 3/1998 |
| JP | 2004129683 | 4/2004 |
| WO | WO 1993/02591 | 2/1993 |
| WO | WO 1998/34514 | 8/1998 |

* cited by examiner

ORAL CARE IMPLEMENT

BACKGROUND

Conventional toothbrushes include a head with tooth cleaning elements thereon. In typical toothbrushes, the tooth cleaning elements are bristles formed of polyamide, polyester, or a similar filament material. Due to the small diameter of such bristles, a toothbrush may include thousands of discrete bristles arranged in tufts and coupled to the head, each of the discrete bristles forming a distinct end point for cleaning. Toothbrushes have also been manufactured that include bristles formed of an elastomeric material thereon. However, there is room for improvement in the characteristics of such elastomeric cleaning elements in terms of softness and effectiveness in removing plaque from teeth. Furthermore, regardless of the material of construction of the cleaning elements, there exists a need to provide a toothbrush designer with additional mechanisms to adjust the stiffness of cleaning element tufts.

BRIEF SUMMARY

The present invention may be directed to an oral care implement having a head with a plurality of bristles or cleaning elements thereon. Alternatively, the invention may be directed to the bristles or cleaning elements themselves. Such cleaning elements may be elongated polygonal shaped structures formed of two components differing in at least one characteristic such as color, additive, and material such that an interface of the two components forms elongated edges of the cleaning elements. The present invention may also be directed to an oral care implement that includes tufts of cleaning elements thereon partially surrounded by sleeves. The cleaning elements may be formed of an elastomeric material and the sleeves may apply a compression force onto the cleaning elements, thereby creating a flaring effect. Furthermore, sleeves of different height may be included on the same oral care implement to achieve different stiffness characteristics of the various cleaning element tufts on the oral care implement.

The present invention may be directed, in one aspect, to an oral care implement comprising a handle; a head coupled to the handle and having a front surface; a plurality of cleaning elements coupled to the head and extending from the front surface of the head; wherein at least one of the plurality of cleaning elements is a first type of cleaning element that extends from a first end to a second end along a longitudinal axis and has a polygonal cross-sectional shape, the first type of cleaning element having an outer surface comprising a plurality of elongated faces extending between the first and second ends and a plurality of elongated edges extending between the first and second ends; and wherein the first type of cleaning element comprises a first component and a second component, the first and second components being different in at least one characteristic, and wherein an interface of the first and second components is located along at least one of the elongated edges.

In another aspect, the invention may be a cleaning element for an oral care implement comprising: a sleeve extending from a first end to a second end along a longitudinal axis, the sleeve having a polygonal cross-sectional shape and an outer surface comprising a plurality of elongated faces extending between the first and second ends and a plurality of elongated edges extending between the first and second ends; and wherein the sleeve comprises a first component and a second component, the first and second components being different in at least one characteristic, and wherein an interface of the first and second components is located along at least one of the elongated edges.

In a further aspect, the invention may be an oral care implement comprising: a handle; a head coupled to the handle and having a front surface; a plurality of cleaning elements coupled to the head and extending from the front surface of the head; wherein at least one of the plurality of cleaning elements is a first type of cleaning element that extends from a first end to a second end along a longitudinal axis and has a polygonal cross-sectional profile, an outer surface of the polygonal cross-sectional profile defined by a plurality of sides and a plurality of corners; and wherein the first type of cleaning element comprises a first component and a second component, the first and second components being different in at least one characteristic, and wherein an interface of the first and second components is located along at least one of the corners.

In yet another aspect, the invention may be oral care implement comprising: a handle; a head coupled to the handle and having a front surface; a tuft of cleaning elements extending from the front surface of the head along an axis and comprising a plurality of cleaning elements formed of an elastomeric material; and a sleeve coupled to the head and extending from the front surface of the head, the sleeve circumferentially surrounding a first portion of the tuft of cleaning elements, a second portion of the tuft of cleaning elements protruding beyond a distal end of the sleeve.

In still another aspect, the invention may be an oral care implement comprising a handle; a head coupled to the handle and having a front surface, at least one tuft hole formed into the front surface; a tuft of cleaning elements having a first portion positioned within the tuft hole and a second portion extending from the front surface of the head along an axis, the tuft of cleaning elements comprising a plurality of cleaning elements formed of an elastomeric material; and wherein the tuft hole applies a compression force onto the first portion of the tuft of cleaning elements thereby causing the second portion of the tuft of cleaning elements to diverge from the axis with increasing distance from the front surface of the head.

In a further aspect, the invention may be an oral care implement comprising a handle; a head coupled to the handle and having a front surface; a first tuft of cleaning elements extending from the front surface of the head along a first axis and comprising a first plurality of cleaning elements; a second tuft of cleaning elements extending from the front surface of the head along a second axis and comprising a second plurality of cleaning elements; a first sleeve coupled to the head and extending from the front surface of the head, the first sleeve circumferentially surrounding a portion of the first tuft of cleaning elements, the first sleeve having a first height measured from the front surface of the head to a distal end of the first sleeve; a second sleeve coupled to the head and extending from the front surface of the head, the second sleeve circumferentially surrounding a portion of the second tuft of cleaning elements, the second sleeve having a second height measured from the front surface of the head to a distal end of the second sleeve; and wherein the first and second heights are different Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
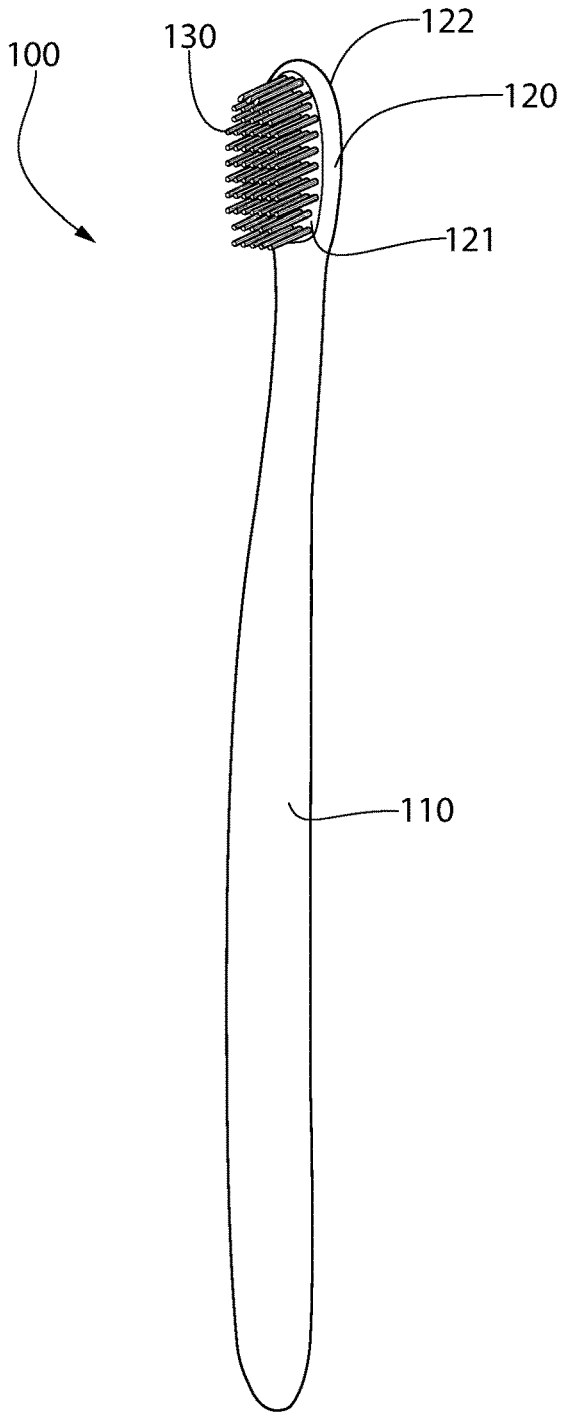
FIG. 1 is perspective view of an oral care implement in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Referring to FIG. 1, an oral care implement 100 will be described in accordance with an embodiment of the present application. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having cleaning elements, or any other type of implement that is commonly used for oral care.

The oral care implement 100 generally comprises a handle 110 and a head 120. The handle 110 is an elongated structure that provides the mechanism by which the user can hold and manipulate the oral care implement 100 during use. In the exemplified embodiment, the handle 110 is generically depicted having various contours for user comfort. Of course, the invention is not to be limited by the specific shape illustrated for the handle 110 in all embodiments and in certain other embodiments the handle 110 can take on a wide variety of shapes, contours, and configurations, none of which are limiting of the present invention unless so specified in the claims.

The handle 110 may be formed of a hard or rigid plastic material, such as for example without limitation polymers and copolymers of ethylene, propylene, butadiene, vinyl compounds, and polyesters such as polyethylene terephthalate. The handle 110 may also include a grip that is formed of a resilient/elastomeric material, such as a thermoplastic elastomer. Such a grip may be molded over a portion of the handle 110 that is typically gripped by a user's thumb and forefinger during use. Furthermore, it should be appreciated that additional regions of the handle 110 can be overmolded with the resilient/elastomeric material to enhance the gripability of the handle 110 during use. For example, portions of the handle 110 that are typically gripped by a user's palm during use may be overmolded with a thermoplastic elastomer or other resilient material to further increase comfort to a user. U.S. Pat. No. 7,458,125, which discloses gripping features on an oral care implement handle, is incorporated herein by reference in its entirety. Furthermore, materials other than those noted above can be used to form the handle 110, including metal, wood, or any other desired material that has sufficient structural rigidity to permit a user to grip the handle 110 and manipulate the oral care implement 100 during toothbrushing.

The head 120 of the oral care implement 100 is coupled to the handle 110 and comprises a front surface 121 and an opposing rear surface 122. In the exemplified embodiment, the head 120 is formed integrally with the handle 110 as a single unitary structure using a molding, milling, machining, or other suitable process. However, in other embodiments the handle 110 and the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus, the head 120 may, in certain embodiments, be formed of any of the rigid plastic materials described above as being used for forming the handle 110, although the invention is not to be so limited in all embodiments and other materials that are commonly used during toothbrush head manufacture may also be used.

In the exemplified embodiment, a plurality of cleaning elements 130 are coupled to the head 120 and extend from the front surface 121 of the head 120. The cleaning elements 130 may be coupled to the head 120 in any manner known in the art, including staples, in-mold tufting, anchor-free tufting (AFT), or a modified AFT known in the art as AMR. A specific embodiment will be described below with reference to FIG. 7 that uses AFT, but it should be appreciated that any of the aforementioned techniques and others may be used in other embodiments. The cleaning elements 130 may be referred to herein in different parts of this disclosure as tooth cleaning elements or bristles. In certain embodiments, the head 120 may have a soft tissue cleanser formed of an elastomeric material or the like positioned on its rear surface 122.

The invention is not to be limited by the structure, pattern, orientation, and material of the cleaning elements 130 on the head 120 in all embodiments. Furthermore, where it does not conflict with the other disclosure provided herein or the claims, it should be appreciated that the term "cleaning elements" may be used in a generic sense to refer to any structure that can be used to clean, polish, or wipe the teeth and/or soft oral tissue (e.g. tongue, cheek, gums, etc.) through relative surface contact. Common examples of "cleaning elements" include, without limitation, bristle tufts, filament bristles, fiber bristles, nylon bristles, polybutylene terephthalate (PBT) bristles, spiral bristles, rubber bristles, elastomeric protrusions, flexible polymer protrusions, combinations thereof, and/or structures containing such materials or combinations. Furthermore, the cleaning elements 130 can be tapered, end-rounded, spiral, or the like. The term "cleaning elements" is not intended to be limiting of the material of construction of such element unless specifically claimed as such.

Figure 2:
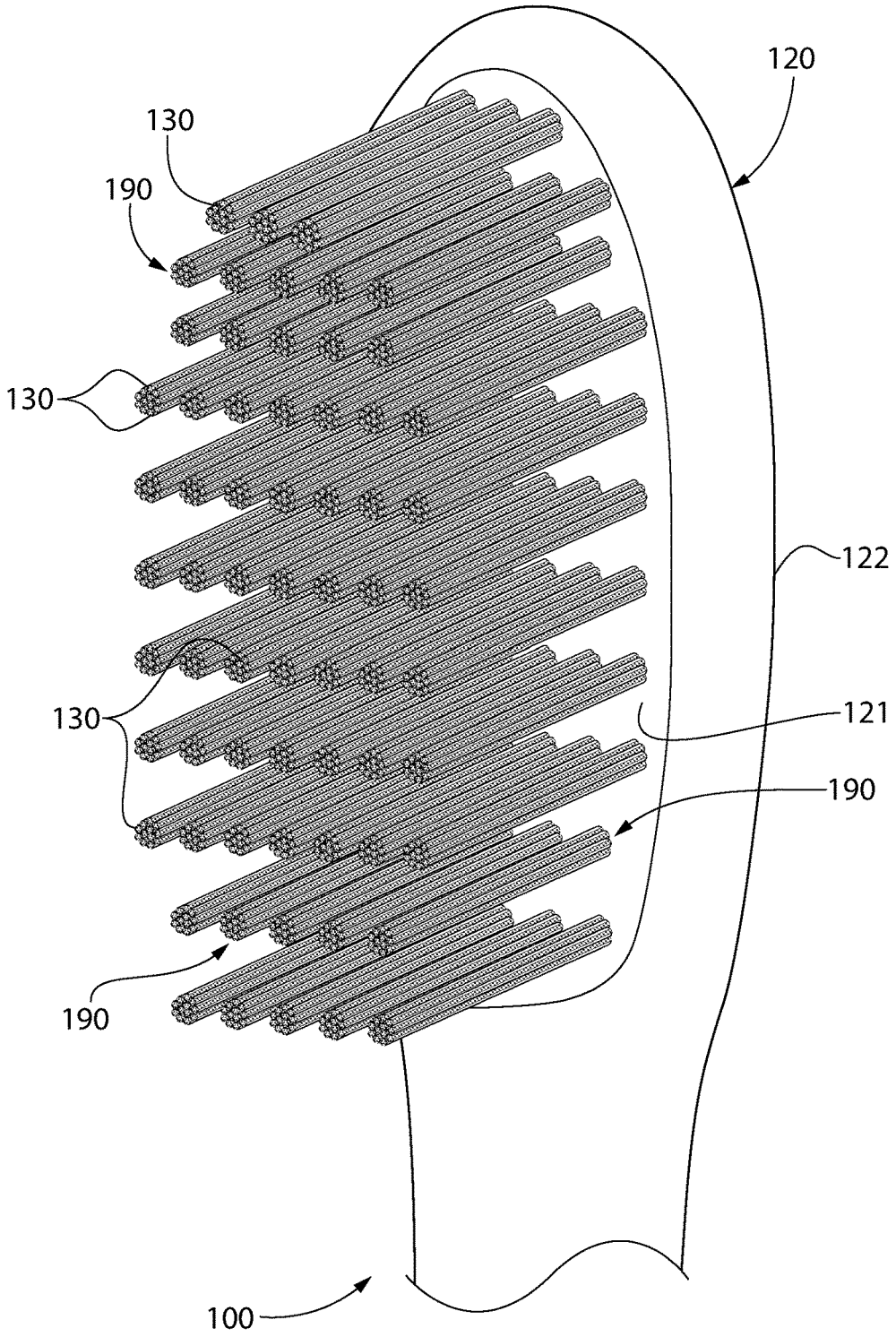
FIG. 2 is a close-up view of the head of the oral care implement of FIG. 1 having tufts of cleaning elements coupled thereto.

Referring to FIG. 2, a close-up view of the head 120 of the oral care implement 100 is illustrated. In the exemplified embodiment, the cleaning elements 130 are grouped together into tufts 190 that are inserted into holes in the head 120. In the exemplified embodiment, each of the tufts 190 includes twelve of the cleaning elements 130. Of course, more or less than twelve of the cleaning elements 130 may be included in one or more of the tufts 190 in other embodiments. After arranging the cleaning elements 130 together into the tufts 190, the tufts 190 may be secured to the head 120 via staple technology or by melting the ends of the cleaning elements 130 that are positioned within the holes (which is AFT technology).

In the exemplified embodiment, each of the cleaning elements 130 is formed at least partially, and in some cases entirely, of one or more elastomeric materials. Such an elastomeric material may be referred to herein as a thermoplastic elastomer. Examples of suitable elastomeric materials that may be used for forming a portion or the entirety of the cleaning elements 130 includes styrene block copolymer, thermoplastic olefin (TPO), polysiloxane, silicone, and thermoplastic polyurethane (TPU). In certain embodiments, the cleaning element 130 is extruded or co-extruded when more than one material is used to form the cleaning element 130 as described in more detail below. Of course, in other embodiments the cleaning element 130 may be formed via an injection molding process if so desired. The materials noted above for forming the cleaning elements 130 is in contrast to the typical material used to form bristle filaments on oral care implements, such as polyamide and polyester. In some embodiments, some of the cleaning elements 130 may be formed of an elastomeric material and others of the cleaning elements 130 on the same head 120 may be formed more conventionally from a polyamide or polyester material. In certain embodiments, one of the cleaning elements 130 is formed at least partially, or entirely, of an elastomeric material. In other embodiments at least one of the tufts 190 consists only of cleaning elements 130 formed of an elastomeric material. In still other embodiments, all of the cleaning elements 130 on the head 120 are formed of an elastomeric material as described herein and have the structural details as described herein below with reference to FIGS. 4A, 4B and 5A.

Some properties of an elastomeric material used to form the cleaning elements 130 include a specific gravity in a range of 0.85-1.45, a durometer in a range of 25 Shore A to 70 Shore D, a tensile strength in a range of 300-8000 psi, an elongation in a range of 150-900%, a tensile modulus in a range of 150-2000 psi, and a tear strength in a range of 300-1500 lb/in. Of course, these ranges are merely for the exemplified embodiment and it is possible that one of more of the above-noted properties may have a value outside of the noted range. The cleaning elements 130 may have an outside diameter between 0.25 and 1.0 mm, more specifically between 0.25 and 0.5 mm, still more specifically between 0.3 mm and 0.4 mm, or between 0.35 mm and 0.4 mm. Furthermore, as described in more detail later on in this document, the cleaning elements 130 may have a round cross-sectional shape/profile or may have a polygonal (non-round) cross-sectional shape such as being triangular, rectangular, diamond, polygonal, star, and/or crucifix shaped in cross-section. Irrespective of the shape, the outside diameter ranges noted above may hold true.

Figure 3:
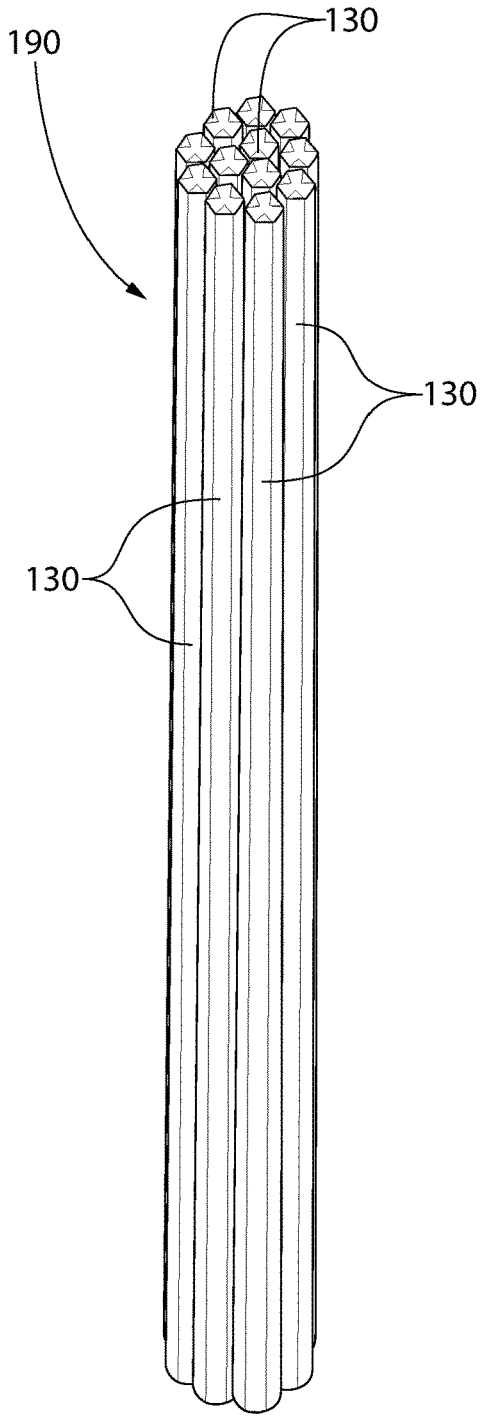
FIG. 3 is perspective view of a tuft of cleaning elements of the oral care implement of FIG. 1.
Figure 4A:
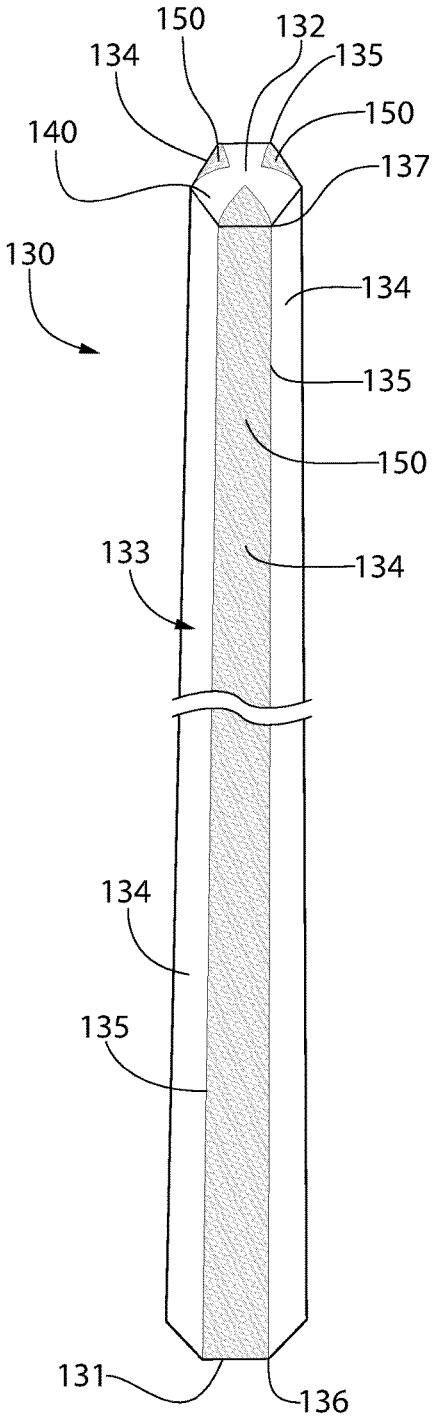
FIG. 4A is a perspective view of one of the cleaning elements of the tuft of FIG. 3.
Figure 4B:
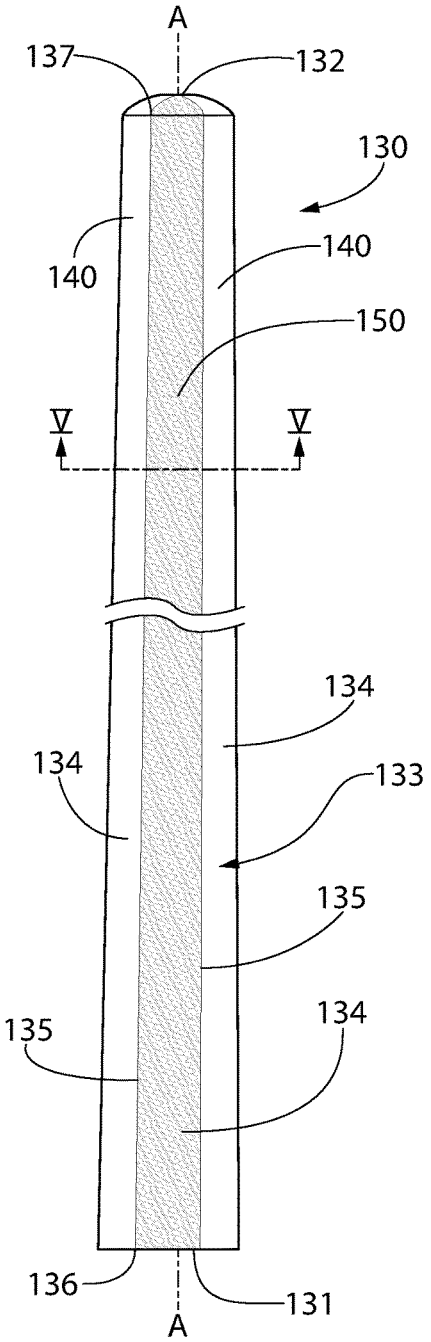
FIG. 4B is a front view of the cleaning element of FIG. 4A.
Figure 5A:
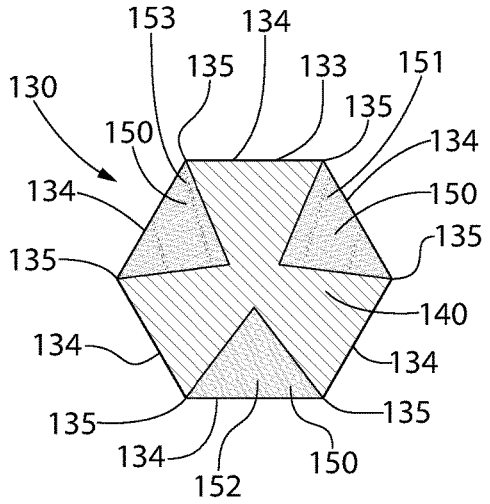
FIG. 5A is a cross-sectional view taken along line V-V of FIG. 4A.
Figure 5B:
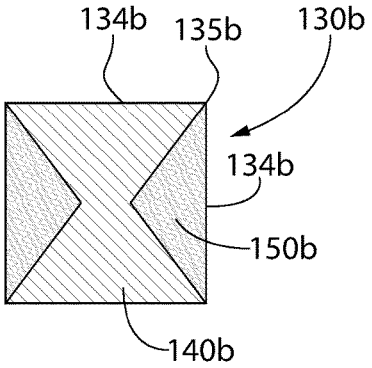
FIGS. 5B-5D are alternative cross-sectional views of differently shaped cleaning elements in accordance with embodiments of the present invention.
Figure 5C:
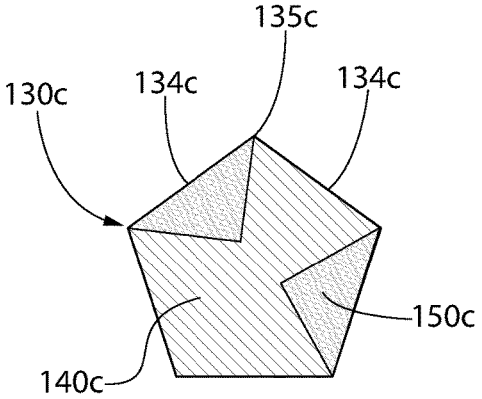
Figure 5D:
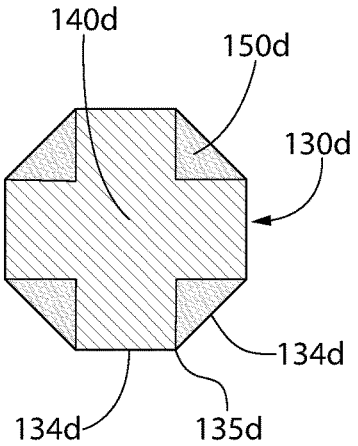

Referring now to FIGS. 3-5A, the cleaning elements 130 will be described in greater detail. The cleaning elements 130 shown in FIGS. 3-5A and described below may form some or all of the cleaning elements 130 on the head 120 as described above. FIG. 3 illustrates one of the tufts 190 of the cleaning elements 130 removed from the head 120. FIGS. 4A, 4B, and 5A illustrate different views of one of the cleaning elements 130. In the exemplified embodiment, the cleaning elements 130 are in the shape of a hexagonal prism. However, for purposes of this embodiment, the cleaning elements 130 may have any preferably elongated polygonal prism shape. Examples of different shapes of the cleaning elements 130 are shown in cross-section in FIG. 5B (square shaped cleaning element 130B), FIG. 5C (pentagon shaped cleaning element 130C) and FIG. 5D (octagon shaped cleaning element 130D). FIGS. 5B-5D are similarly numbered to FIGS. 4A-5A except that the suffixes "b," "c," and "d" are used. Thus, to the extent that FIGS. 5B-5D are not described in detail below, it should be appreciated that the description of FIGS. 4A, 4B, and 5A is applicable.

Referring collectively to FIGS. 4A, 4B, and 5A, one of the cleaning elements 130 will be described in detail. The cleaning element 130 may be referred to herein as a first type of cleaning element. This is because the oral care implement 100 may include one or more of the cleaning elements 130 as well as one or more other types of cleaning elements, such as conventional filament bristles or the like as described above. Thus, although in FIG. 2 all of the cleaning elements 130 appear to be the same (all of them are the first type of cleaning element), the invention is not limited to this in all embodiments. In other embodiments at least one tuft may consist of a grouping of the cleaning elements 130 (i.e., the first type of cleaning element), and in other embodiments the cleaning elements 130 (i.e., the first type of cleaning elements) may be intermixed in tufts with other types of cleaning elements 130.

The cleaning element 130 extends from a first end 131 to a second end 132 along a longitudinal axis A-A. The first end 131 may be the end of the cleaning element 130 that is inserted into the hole in the head 120 and the second end 132 may be the end furthest from the head 120 that is used for cleaning of a user's oral surfaces (when using AFT techniques for coupling the cleaning element 130 to the head 120). In other embodiments the cleaning element 130 may be folded in half and the bent portion inserted into the hole in the head 120 such that both the first and second ends 131, 132 will be positioned at a distance from the head 120 for engaging a user's oral surfaces (when using stapling techniques for coupling the cleaning element 130 to the head 120). In the exemplified embodiment, the cleaning elements 130 are end-rounded at the second end 132. However, the invention is not to be so limited in all embodiments and the cleaning element 130 may be tapered, pointed, or may include fingers at the second end 132 in alternative embodiments.

As noted above, the cleaning element 130 has a polygonal cross-sectional shape, which in the exemplified embodiment is hexagonal (although any polygonal cross-sectional shape may be used as described herein). Due to the polygonal prism-like shape (which may have an end-rounded or tapered second end 132 in some embodiments instead of a flat planar end) of the cleaning element 130, the cleaning element 130 has an outer surface 133 comprising a plurality of elongated faces 134 that extend the entire distance between the first and second ends 131, 132 of the cleaning element 130 and a plurality of elongated edges 135 extending the entire distance between the first and second ends 131, 132 of the cleaning element 130. Adjacent ones of the elongated faces 134 meet to form the elongated edges 135. Each of the elongated edges 135 extends from a vertex 136 at the first end 131 to a vertex 137 at the second end 132. Each of the elongated sides 134 extends between two adjacent edges 135 along the entirety of the length of the cleaning element 130.

In the exemplified embodiment, the cleaning element 130 comprises a first component 140 and a second component 150. The first component 140 forms a spine of the cleaning element 130 in that it is the backbone or main structural component of the cleaning element 130. In the exemplified embodiment, the first component 140 comprises a plurality of elongated channels 141 that extend along the entire length of the cleaning element 130. In other embodiments, the elongated channels 141 may extend part of but not the entirety of the length of the cleaning element 13. For example, the elongated channels 141 may extend between the first and second ends 131, 132 without extending to the first and second ends 131, from the first end 131 along the length but not all the way to the second end 132, or from the second end 132 along the length but not all the way to the first end 131).

In the exemplified embodiment, the second component 150 is disposed within and fills in each of the channels 141 to form the desired polygonal shape of the cleaning element 130. Thus, in the exemplified embodiment the second component 150 comprises a first section 151, a second section 152, and a third section 153, the first, second, and third sections 151-153 being isolated from one another by the first component 140. Thus, in the exemplified embodiment the first, second, and third sections 151-153 are wholly separate and distinct from one another such that they do not touch. Of course, the invention is not to be so limited and in other embodiments the first, second, and third section 151-153 of the second component 150 may be connected, for example in a center of the cross-sectional profile of the cleaning element 130.

In the exemplified embodiment, each of the channels 141, and hence also each of the first, second, and third sections 151-153 of the second component 150, have a triangular cross-sectional shape (and thus a triangular prism shape overall). However, the invention is not to be so limited and the sections 151-153 of the second component 150 may have any other desired shape such as semicircular, square, or the like. However, in certain embodiments it is desired that the second component 150 forms an entirety of at least one of the elongated faces 134 of the cleaning element 130, as discussed in more detail below.

In the exemplified embodiment, each adjacent one of the elongated faces 134 is formed by a different one of the first and second components 140, 150 along the entire length of the cleaning element 130 between the first and second ends 131, 132. Thus, where one of the elongated faces 134 is formed by the first component 140, each elongated face adjacent to the one of the elongated faces 134 is formed by the second component 150. Stated another way, in some embodiments none of the adjacent elongated faces 134 are formed from the same one of the first and second components 140, 150. However, this is not required in all embodiments. In other embodiments, adjacent elongated faces 134 may be formed of the same one of the first and second components 140, 150. However, there should be at least one interface of the first and second components 140, 150 located along one of the elongated edges 135.

If the first component 140 extends along an entire length of the cleaning element 130 along one elongated face 134 and the second component 150 extends along an entire length of the cleaning element 130 along an adjacent elongated face 134, the interface of the first and second components 140, 150 will be located along or will form the elongated edge 135 formed by those two adjacent elongated faces 134 along the entire length of the cleaning element 130. In the embodiment of FIGS. 4A, 4B, and 5A, adjacent elongated faces 134 alternate between being formed from the first component 140 and the second component 150 such that an interface of the first and second components 140, 150 is located along each of the elongated edges 135. As noted above, this is not required in all embodiments (see FIG. 5C for example where the first component 140*c* forms two of the adjacent elongated faces 134*c* but there remains an elongated edge 135*c*, four elongated edges 135*c* to be exact, formed by an interface of the first and second components 140*c*, 150*c*).

The elongated faces 134 and the elongated edges 135 of the cleaning element 130 collectively form the outer surface 133 of the cleaning element 130. Thus, by having the first component 140 and the second component 150 form different ones of the elongated faces 134, both the first and second components 140, 150 are exposed on the outside of the cleaning element 130. Furthermore, the first and second components 140, 150 may be different than one another in at least one characteristic, attribute, or feature. As a result, the different characteristics or features of each of the first and second components 140, 150 may be imparted to a user of an oral care implement having one or more of the cleaning elements 130 thereon.

Although described herein based on the elongated faces 134 and the elongated sides 135, the cleaning elements 130 may also be described by an outer surface of the polygonal cross-sectional profile thereof. Specifically, referring to FIG. 5A the outer surface of the polygonal cross-sectional profile has a plurality of sides (equivalent to the elongated faces) and a plurality of corners (equivalent to the elongated edges). At least one of the sides is formed by the first component 140 and at least one adjacent side is formed by the second component 150. As a result, an interface of the first and second components may be located at or form at least one of the corners of the cross-sectional profile.

In one embodiment, the first and second components 140, 150 may differ in terms of their material of construction (i.e., a first characteristic). A single cleaning element 130 having different materials in different exposed portions thereof may result in an added benefit to a user. For example, the first component 140 may be formed of a first elastomeric material (say, for example, TPU) and the second component 150 may be formed of a second elastomeric material (say, for example, TPO). As another example, the first component 140 may be formed of polyamide (e.g., nylon) or polyester and the second component 150 may be formed of an elastomeric material. Of course, the example could be flipped and the first component 140 may be formed of an elastomeric material and the second component 150 may be formed of polyamide or polyester. By having different materials on the same cleaning element 130, different degrees of rigidity, different surface textures, different hardness values, and the like may be felt by the user during brushing. Furthermore, having both of the materials exposed on the outer surface of the cleaning element 130 ensures that both materials contact a user's oral surfaces during use of the oral care implement 100 so that the benefits of both of the first and second components 140, 150 may be received by the user.

In another embodiment, the first and second components 140, 150 may differ in terms of color (i.e., a second characteristic). Thus, the first component 140 may comprise a first color whereas the second component 150 may comprise a second color that is different than the first color. The term "different color" as used herein includes different shades of the same color so long as it is readily discernable by the ordinary viewer. Furthermore, in some embodiments the term "different color" may include any difference in appearance that is visually perceptible (for example, translucent vs. opaque with the same base color). In one embodiment, the first color of the first component 140 may be white and the second color of the second component 150 may be green or blue or red (or any other desired color that contrasts with white) These colors may be paired with one or both of the first and second components 140, 150 having an additive or sensate that imparts a sensory (i.e., trigeminal, a flavor, or the like) response to a user that the color is indicative of (i.e., green color indicates a spearmint flavor, blue color indicates a winterfresh flavor, red indicates a cinnamon flavor, etc.). In still other embodiments, where the second component 150 has sections 151-153 as described above, each section 151-153 may have a different color from each other section 151-154 and from the first component 140. This may be done for marketing as described above (to indicate a flavor or the like or to match the colors of a company logo) or for merely aesthetic purposes.

In other embodiments, the first and second components 140, 150 may differ in terms of an additive carried by the first and/or the second component 140, 150 (i.e., a third characteristic). Thus, in some embodiments the first component 140 may comprise a first additive and the second component 150 may comprise a second additive that is different than the first additive. In other embodiments, one of the first and second components 140, 150 may include an additive whereas the other of the first and second components 140, 150 may be free of an additive.

When the cleaning element 130 is used on an oral care implement 100 as described herein, the additive(s) can be specifically selected to impart a desired benefit to a user's oral cavity. Thus, the additive may be an oral care additive or an oral care agent. Such oral care additives include, without limitation, lotus seed; lotus flower, bamboo salt; jasmine; corn mint; *camellia*; aloe; gingko; tea tree oil; xylitol; sea salt; vitamin C; ginger; cactus; baking soda; pine tree salt; green tea; white pearl; black pearl; charcoal powder; nephrite or jade and Ag/Au+.

The lotus seed is the extract from lotus seeds and is a natural herb for anti-heating and the prevention of gum bleeding. The lotus flower is the extract from the lotus flower and is a natural herb for anti-heating and the prevention of gum bleeding. Bamboo salt is the combination of a bamboo extract and salt and is used to diminish inflammation and has anti-bacterial effects. Jasmine is an extract from the jasmine flower and is a natural herb for anti-heating, preventing gum bleeding and for mouth freshening. Corn mint is an extract from a corn mint leaf and is a natural herb for anti-heating, anti-bacterial uses and mouth freshening. *Camellia* is an extract from the *camellia* flower and is a natural herb for anti-heating and the prevention of gum bleeding. Aloe is an extract from the aloe leaf and is a natural herb for inflammation reduction and has anti-bacterial effects. Gingko is an extract from the gingko leaf and is a natural herb for inflammation reduction and has anti-bacterial effects. Tea tree oil is an extract from a tea tree and is a natural herb for diminishing inflammation and has anti-bacterial effects. Xylitol is an extract from plants such as corn, sugar cane, oak, birch, etc. and can be used for preventing tooth decay. Sea salt is an extract from the sea and can be used to reduce inflammation and has anti-bacterial effects. Vitamin C is an extract from food and can be used to prevent gum bleeding and as an antioxidant. Ginger is an extract from ginger and is a natural plant for diminishing inflammation and has anti-bacterial effects. Cactus is an extract from a cactus and it a natural plant for reducing inflammation and can be used as an antioxidant. Backing soda is a chemistry product and can be used as an enamel protectant. Pine tree salt is a mixture of the extract from pine trees and salt and is an ancient Chinese medicine for preventing inflammation and anti-heating. Green tea is an extract from the green tea leaf and is a natural herb to prevent halitosis and inhibit bacteria growth. White pearl is a kind of pearl powder and can be used for teeth whitening and teeth health improvement by calcium absorption. Black pearl is a kind of pearl powder that can be used for teeth whitening, cleaning and stain removal. Charcoal is made from an oak tree by carbonization and it helps to for moisture adjustment and to reduce the growth of bacteria. Nephrite (jade) is a kind of nephrite powder and can be used to prevent gum disease and boost the blood circulation of the gums. Ag/Au is an anti-bacterial additive contained in the Ag/Au ion (i.e., silver/gold) and can be used to inhibit bacterial growth. In certain embodiments, each of the first and second oral care additives are selected from a group consisting of a mixture of pine tree extract and salt, a tea leaf extract, a pearl powder, a nephrite powder, a charcoal powder, and an antibacterial material. In some embodiments, the oral care additives are natural ingredients.

In other embodiments, the additive(s) may be an oral care agent selected from the group consisting of antibacterial agents (chlorhexidine, cetyl pyridininum chloride, triclosan, and zinc salts); oxidative or whitening agents (hydrogen peroxide, urea peroxide, sodium percarbonate, and PVP-$H_2O_2$); supercharged fluoride delivery ingredients; tooth sensitivity ingredients; gum health actives (Univestin, bachalin, polyphenols, triclosan, ethyl pyruvate, and guanidinoethyl disulfide); nutritional ingredients (vitamins, minerals, amino acids, vitamin E, and folic acid); tartar control or anti-stain ingredients (phosphate salts, polyvinylphosphonic acid, and PVM/MA copolymer); enzymes; sensate ingredients; flavors or flavor ingredients (menthol, carvone, anethole, aldehydes, esters, alcohols, and oils of spearmint, peppermint, wintergreen, *sassafras*, clove, sage, *eucalyptus*, marjoram, cinnamon, lemon, lime, grapefruit, or orange); anti-cavity or enamel repair agents; breath freshening ingredients; oral malodor reducing agents; anti-attachment agents; diagnostic solutions; occluding agents (bioactive glass and arginine salts); and combinations thereof. In still other embodiments, the additive may be small particles that provide a mild abrasive cleaning action to the cleaning elements 130, such as by altering the texture or topography of the outer surface of the cleaning elements 130.

As noted above, the additives can be paired with colors of the first and second components 140, 150 to inform a consumer of the flavor or other benefit imparted by the additive. Thus, the first and second components 140, 150 may differ by one or more than one of the characteristics described above (material, color, and/or additive). It should be noted that the characteristics noted above are merely exemplary in nature and the first and second components 140, 150 may differ in other characteristics in addition to or as an alternative to the characteristics which have been described herein.

Figure 6:
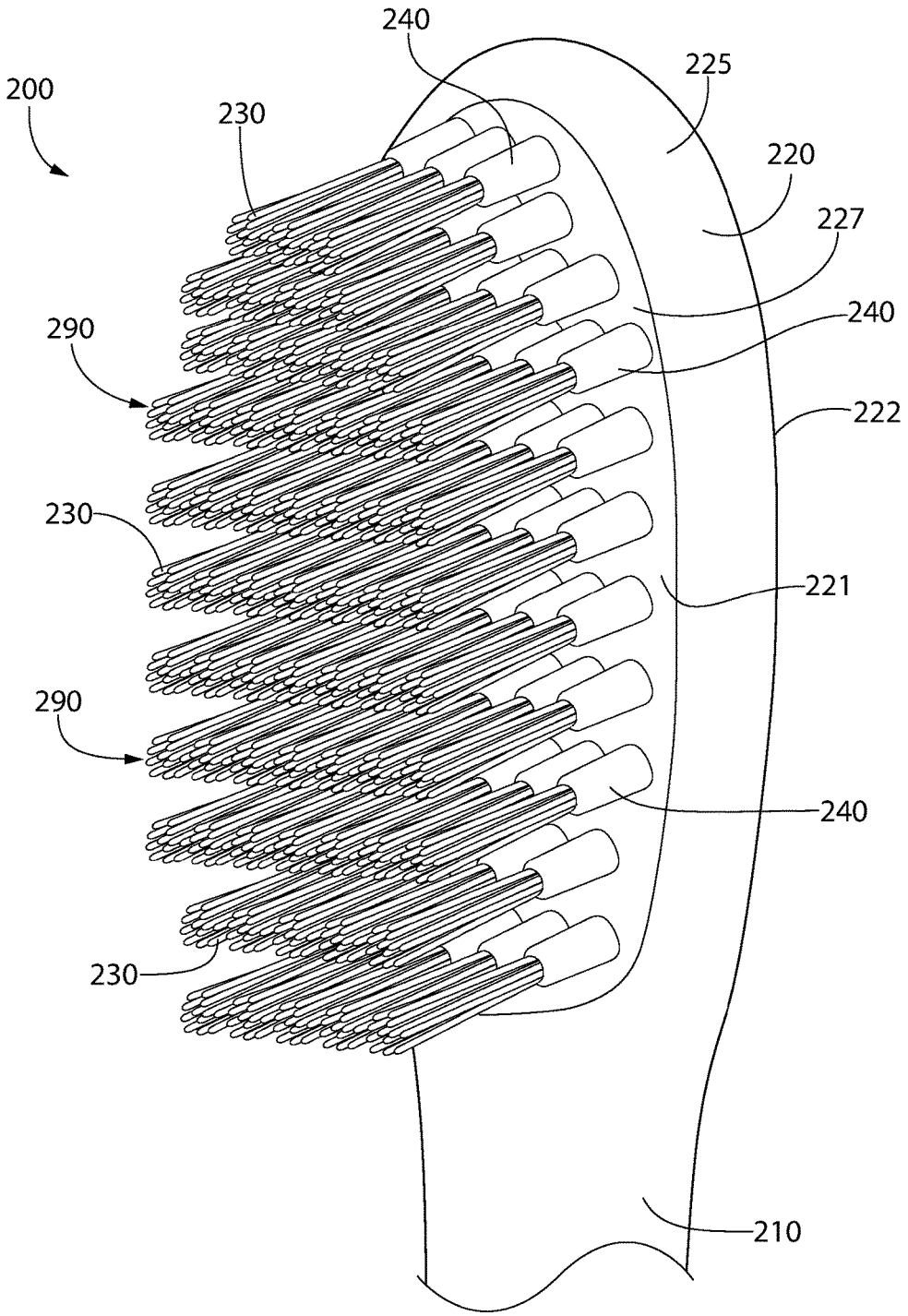
FIG. 6 is a close-up view of a head of an oral care implement having sleeves and tufts of cleaning elements therein in accordance with another embodiment of the present invention.
Figure 7:
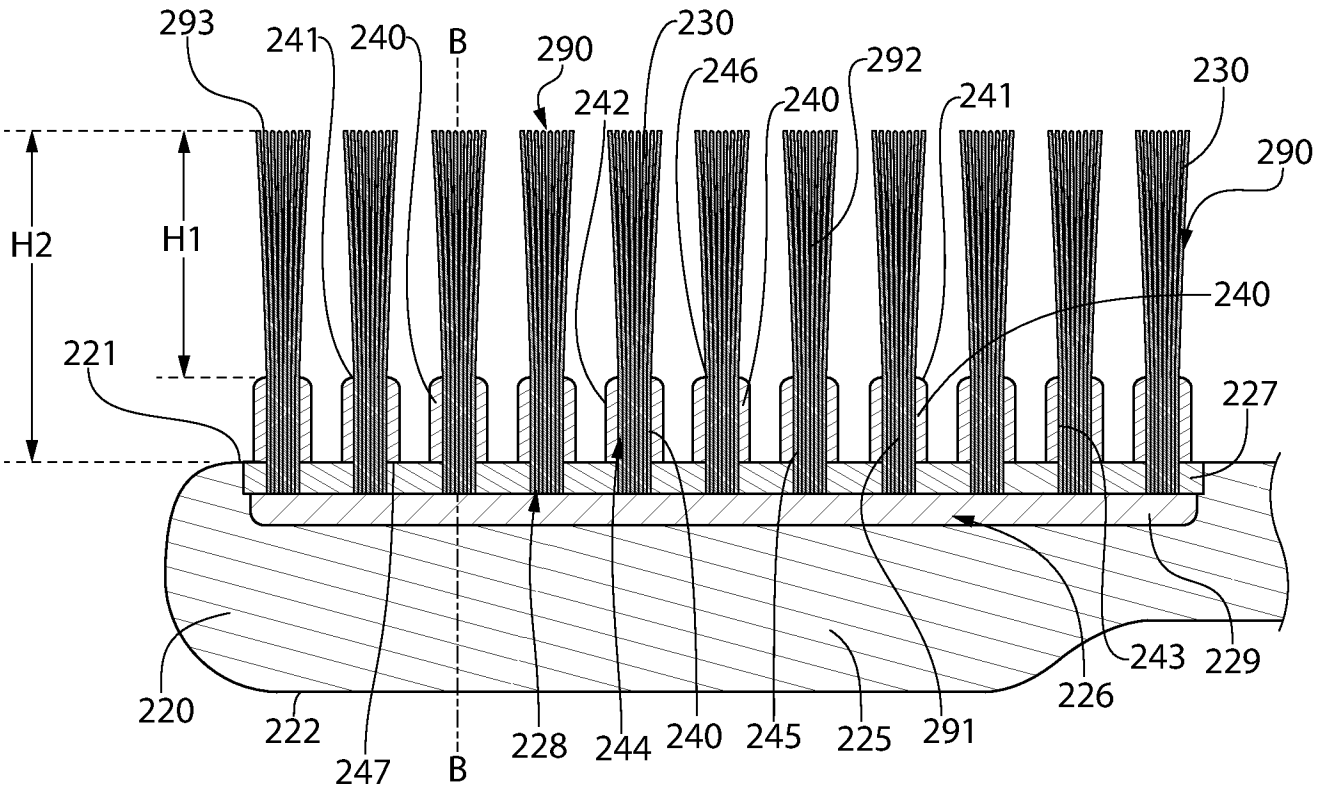
FIG. 7 is a cross-sectional view taken along line VII-VII in FIG. 6.

Referring now to FIGS. 6 and 7 concurrently, an oral care implement 200 will be described in accordance with another embodiment of the present invention. The oral care implement 200 generally comprises a handle 210 and a head 220 similar to what was described above with regard to the oral care implement 100. Thus, in FIG. 6 only the head 220 and a very small portion of the handle 210 is shown, but it should be appreciated that the illustration of the handle in FIG. 1 and the related description above is applicable.

The head 220 includes a front surface 221 and an opposite rear surface 222.

Furthermore, a plurality of cleaning elements 230 are coupled to the head 220 and extend from the front surface 221 of the head 220. In this embodiment, the cleaning elements 230 are coupled to the head 220 using an anchor free tufting (AFT) technique. Specifically, the head 220 includes a base portion 225 having a basin 226 therein and a head plate 227 that is separately formed from the base portion 225. In some embodiments, the base portion 225 may be formed integrally with the handle 210. The head plate 227 has a plurality of openings 228 therethrough. The cleaning elements 230 are arranged into tufts 290 as described above and portions of the cleaning elements 230 are inserted through the openings 228 in the head plate 227. The portions of the cleaning elements 230 that are inserted through the openings 228 are melted (such as by applying heat thereto) to form a melt mat 229. The melt mat 229 couples the cleaning elements 230 to the head plate 227 and prevents the cleaning elements 230 from being pulled through the head plate 227 in at least one direction perpendicular to the front surface of the head plate 227. The head plate 227 with the cleaning elements 230 coupled thereto is then inserted into the basin 226 of the base portion 225 of the head 220 with the melt mat 229 adjacent and/or in contact with a floor of the basin 226. The head plate 227 is then secured to the base portion 225 of the head 220 such as via ultrasonic welding, adhesives, or the like. As a result of this process, the cleaning elements 230 are coupled to the head 220 securely and cannot be easily separated from the head 220. Of course, this is merely one technique for coupling the cleaning elements 230 to the head 220 and other techniques are possible such as stapling, IMT, AMR and the like, which are known to persons skilled in the art.

In this embodiment, the cleaning elements 230 may preferably be formed of an elastomeric material such as that which has been described herein above. Specifically, suitable elastomeric materials that may be used for forming a portion or the entirety of the cleaning elements 130 includes styrene block copolymer, thermoplastic olefin (TPO), polysiloxane, silicone, and thermoplastic polyurethane (TPU). In certain embodiments, the cleaning elements 230 are extruded (or co-extruded when more than one material is used to form the cleaning element 230). Of course, in other embodiments the cleaning elements 230 may be formed via an injection molding process if so desired. Furthermore, similar to that which was described above, in certain embodiments the cleaning elements 230 have an outside diameter between 0.25 and 1.0 mm, more specifically between 0.25 and 0.5 mm, still more specifically between 0.3 mm and 0.4 mm, or between 0.35 mm and 0.4 mm. Furthermore, the cleaning elements 230 may have a round cross-sectional shape/profile as illustrated in the exemplified embodiment or may have a polygonal (non-round) cross-sectional shape such as being triangular, rectangular, diamond, polygonal, star, and/or crucifix shaped in cross-section. Irrespective of the shape, the outside diameter ranges noted above may hold true.

Because the cleaning elements 230 are formed of an elastomeric material, these cleaning elements 230 may have a stiffness that is less than that of traditional filament bristles such as those made from polyamide and/or polyester. Therefore, it may be desirable in certain embodiments to surround all or a part of the cleaning elements 230 with a sleeve 240 to increase the net stiffness of the tuft 290.

Therefore, in the exemplified embodiment in addition to the cleaning elements 230 there is a plurality of sleeves 240 extending from the front surface 221 of the head 220 in a spaced apart manner. Each of the sleeves 240 may be separately coupled to the head 220 or the sleeves 240 may be formed as a part of an integral structure, such as a pad, that is coupled to the head 220. The sleeves 240 may be formed of an elastomeric material (TPE, TPU, or any other elastomeric material described previously herein) or a more rigid plastic material (such as those described herein for forming the handle 110 of the oral care implement 100). In one preferable embodiment, the sleeves 240 are formed of an elastomeric material to ensure comfort during brushing because a more rigid material might interfere with the brushing process or result in uncomfortable contact with a user's teeth and gums. In one embodiment, the sleeves 240 may be injection molded onto the head 220 and/or securely coupled to the head 220 due to a mechanical interference (i.e., interlocking flanges or the like). Alternatively, the sleeves 240 may be coupled to the head 220 using other techniques including adhesives, welding, interference fit, lock-and-key fit, or the like. The sleeves 240 may be secured within grooves or channels formed into the front surface 221 of the head 220 (or head plate 229) using injection molding techniques or otherwise as described herein. Thus, the invention is not to be limited by the manner in which the sleeves 240 are coupled to the head 220 in all embodiments.

As noted above, the cleaning elements 230 are grouped or arranged together into tufts 290 that are coupled to the head 220. Each of the tufts 290 extends a height H2 from the front surface 221 of the head 290 to a distal end 293 of the tuft 290 (which may be the distal end of the tallest cleaning element 230 in the tuft 290 if the cleaning elements 230 within the tuft 290 have varying heights). Each tuft 290 extends from the head 220 along an axis B-B. In the exemplified embodiment, for each of the tufts 290, one of the sleeves 240 is positioned so as to circumferentially surround the tuft 290 along a portion of the height H2 of the tuft 290. Thus, in this embodiment each of the sleeves 240 extends a height H1 measured from the front surface 221 of the head 220 to a distal end 241 of the sleeve 240. The height H1 of the sleeves 240 is less than the height H2 of the tufts 290. In one embodiment the height H2 of the tuft 290 is at least twice, or at least three times, or at least four times the height H1 of the sleeve 240 within which that tuft 290 is positioned. Of course, this is merely for certain embodiments and in other embodiments the height H1 of the sleeve 240 relative to the height H2 of the tuft 290 disposed therein may be changed to achieve different stiffness levels of the tuft 290 as described in more detail below with reference to FIGS. 14 and 15. Thus, a first portion 291 of the tufts 290 are surrounded by one of the sleeves 240 and a second portion 292 of the tufts 290 protrude beyond the distal end 241 of the sleeve 240.

Figure 8A:
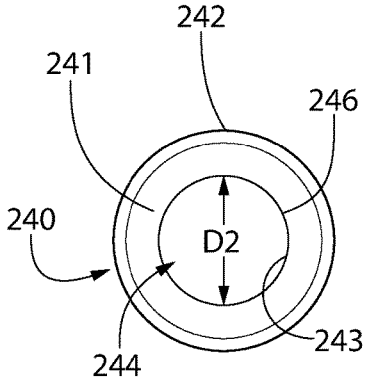
FIG. 8A is a top view of one of the sleeves of FIG. 6.

Referring to FIGS. 7 and 8A concurrently, in the exemplified embodiment the sleeve 240 is a tubular structure having an outer surface 242 and an inner surface 243 that defines a passageway 244. The sleeve 240 has a round cross-sectional shape in the exemplified embodiment, but the invention is not limited to this and the sleeve 240 may take on any shape about its outer surface. It is preferable that the cross-sectional shape of the passageway 244 be similar to that of the openings (or tuft holes) 228 (which is round in the exemplified embodiment but could be polygonal such as square, hexagonal, or the like in other embodiments). The sleeve 240 has a first opening 245 at its distal end 241 and a second opening 246 at its proximal end 247. Thus, the passageway 244 extends entirely through the sleeve 240 along its entire height H1. This is required because bottom ends of the cleaning elements 230 and tufts 290 must be able to extend through the second opening 246 to be secured to the head 220 and upper ends of the cleaning elements 230 and tufts 290 must be able to extend through the first opening 245 to be exposed and available for contact with a user's oral surfaces. The passageway 244 of the sleeve 240 has a diameter D2 defined by the inner surface 243 of the sleeve 240.

Figure 8B:
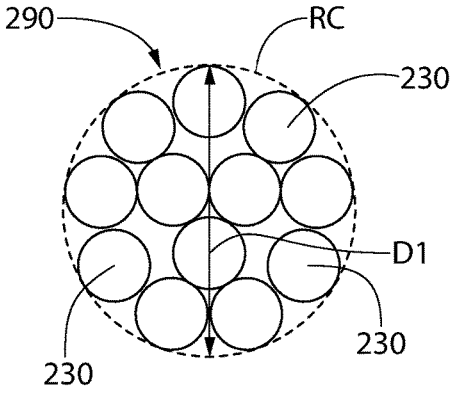
FIG. 8B is a top view of one of the tufts of cleaning elements of FIG. 6.
Figure 11:
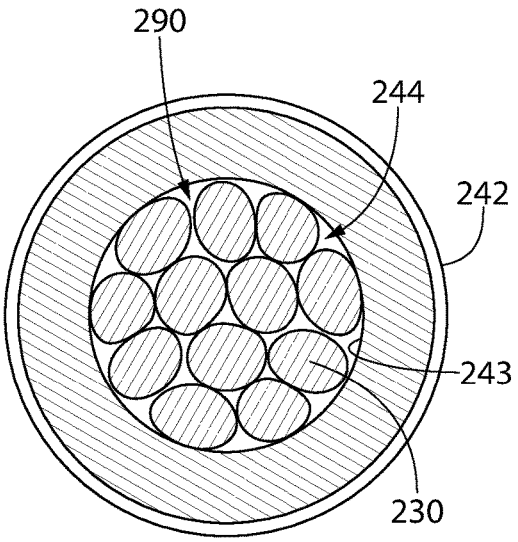
FIG. 11 is a cross-sectional view taken along line X1-X1 of FIG. 10.

Referring to FIG. 8B, one of the tufts of cleaning elements 290 is illustrated in an uncompressed state. By uncompressed state, it is meant that a desired number of the cleaning elements 230 are gathered together and arranged into a tuft 290 without applying any pressure or force on the cleaning elements in a direction orthogonal to the longitudinal axis B-B of the tuft 290. Because the cleaning elements 230 are formed of an elastomeric material as described above, when a force orthogonal to the longitudinal axis B-B of the tuft 290 (or a radial force) is applied the cleaning elements 230 will slightly deform from their uncompressed shape and will move closer together. The deformation of the cleaning elements 230 is best illustrated in FIG. 11. In the uncompressed state, the tuft 290 of the cleaning elements 290 is defined by a reference circle RC having a diameter D1.

Figure 9:
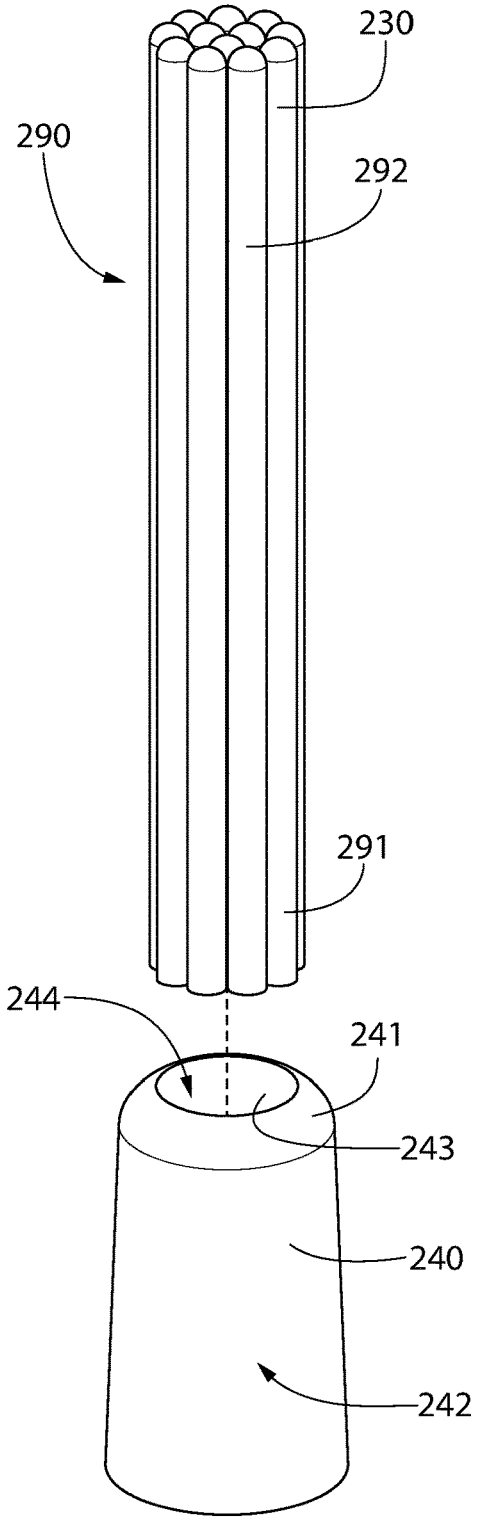
FIG. 9 is an exploded perspective view of one of the tufts of cleaning elements and one of the sleeves of FIG. 6.

FIG. 9 illustrates the tuft 290 of cleaning elements 230 exploded from the sleeve 240. In the exemplified embodiment, the diameter D1 of the reference circle RC is greater than the diameter D2 of the passageway 244 of the sleeve 240. Thus, the tuft 290 can not be inserted into the passageway 244 of the sleeve 240 without compressing the cleaning elements 230 thereof thereby decreasing the diameter of the tuft 290 along the first portion 291 of the tuft 290. The invention is not limiting regarding whether the tuft 290 is inserted into the sleeve 240 after both components are formed or whether the sleeve 240 is formed around the tuft 290. For example, both the sleeve 240 and the tuft 290 may be formed separately, and then the tuft 290 can be force fit into the sleeve 240 (by radially compressing the tuft 290 or any other technique). Alternatively, the tuft 290 may be secured to the head 220, and then the sleeve 240 may be formed, for example via injection molding, directly onto the head 220 in a manner so as to circumferentially surround the first portion 291 of the tuft 290 as described herein. Other techniques are also possible as can be appreciated by persons skilled in the art.

Figure 10:
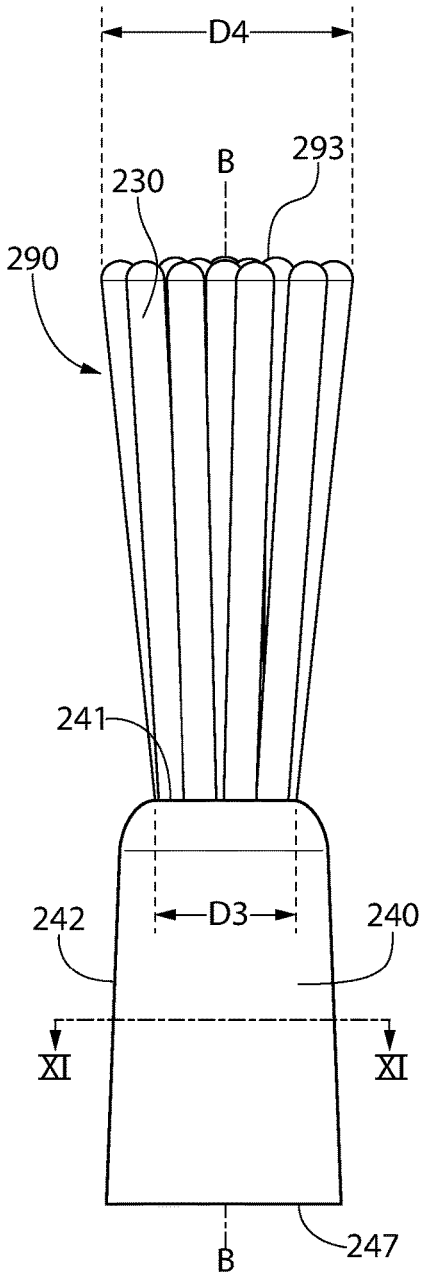
FIG. 10 is a front view illustrating one of the tufts of cleaning elements of FIG. 6 within one of the sleeves of FIG. 6.

Referring to FIGS. 10 and 11, one of the tufts 290 of the cleaning elements 230 is illustrated positioned within the passageway 244 of one of the sleeves 240. When the first portion 291 of the tuft 290 is positioned within the passageway 244 of the sleeve 240 so as to be circumferentially surrounded by the sleeve 240, the first portion 291 of the tuft 290 is radially compressed by the sleeve 240 about the entire circumference of the tuft 290. This is a direct result of the passageway 244 of the sleeve 240 having a diameter D2 that is less than the diameter D1 of the uncompressed tuft 290. Specifically, because the diameter D2 of the sleeve 240 is less than the diameter D1 of the uncompressed tuft 290, the tuft 290 must be radially compressed by the inner surface 243 of the sleeve 240 when it is circumferentially surrounded by the sleeve 230. Radial compression on the tuft 290 causes the first portions 291 of the cleaning elements 230, which are positioned within the passageway 244 of the sleeve 240 and are formed of an elastomeric material, to become deformed or to have a distorted shape.

Due to the radial compression force acting on the first portion 291 of the tuft 290, the second portion 292 of the tuft 290 (which is the portion of the tuft 290 that extends beyond the distal end 241 of the sleeve 240) flares from the distal end 241 of the sleeve 240 to the distal end 293 of the tuft 290. Stated another way, within the second portion 292 of the tuft 290, the cleaning elements 230 diverge from the axis B-B with increasing distance from the distal end 241 of the sleeve 240. The tuft 290 of the cleaning elements 230 has a diameter D3 at the distal end 241 of the sleeve 240 and a diameter D4 at the distal end 293 of the tuft 290. The diameter D4 at the distal end 293 of the tuft 290 is greater than the diameter D3 at the distal end 241 of the sleeve 240. Thus, within the first portion 291 of the tuft 290, the cleaning elements 230 are squeezed tightly together to fit within the passageway 244 and within the second portion 292 of the tuft 290, which is not being acted on by the sleeve 240, the cleaning elements 230 begin to diverge away from one another.

In the embodiment of FIGS. 6-11, each of the tufts 290 of the cleaning elements 230 is circumferentially surrounded by one of the sleeves 240 along a portion of its height. However, the invention is not to be so limited in all embodiments. In some embodiments, some of the tufts 290 may be circumferentially surrounded by one of the sleeves 240 while others of the tufts 290 may not be surrounded by one of the sleeves 240.

By flaring the tufts 290 as described herein, the oral care implement 200 increases the perception of softness both in mouth feel and visual perception. Furthermore, flaring the tufts 290 provides a greater spacing between the cleaning elements 230 in each tuft 290 at the distal end 293 of the tuft 290, which is the end most likely to engage and contact a user's oral surfaces. Thus, each tuft 290 is able to clean a greater tooth surface area than traditional tufts due to this flaring/diverging of the cleaning elements 230. Furthermore, pairing this flaring/diverging nature of the tufts 290 with the cleaning elements 230 being formed of an elastomeric material increase the cleaning efficiency and effectiveness. The elastomeric material results in the cleaning elements 230 performing more of a wiping action on the teeth, and having the diverging ends allows the cleaning elements 230 to surround and then wipe an entire surface of the tooth with a simple or limited motion of the oral care implement 200 by the user.

Figure 12:
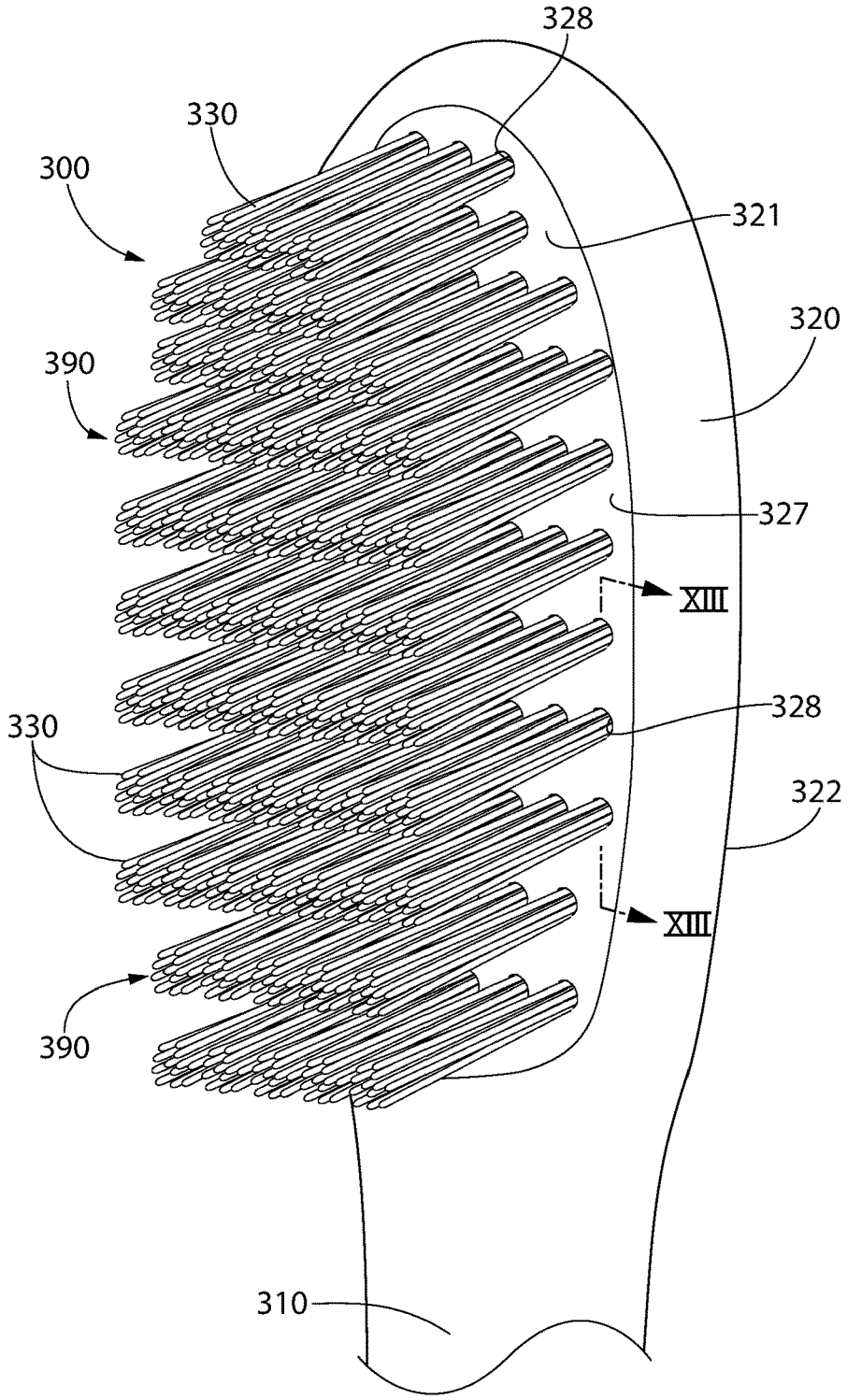
FIG. 12 is a close-up view of a head of an oral care implement in accordance with a further embodiment of the present invention.
Figure 13:
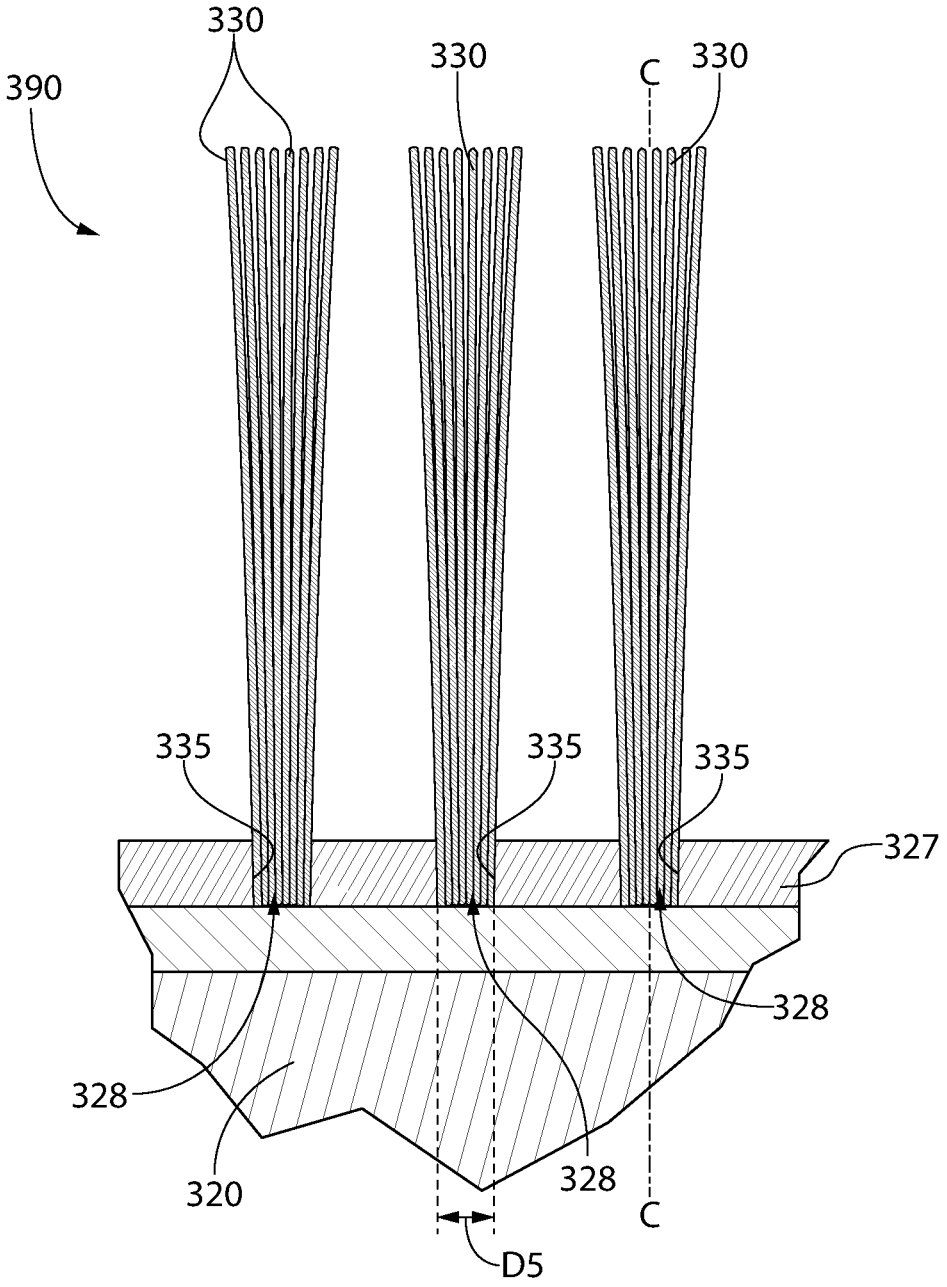
FIG. 13 is a cross-sectional view taken along line XIII-XIII of FIG. 12.

Referring to FIGS. 12 and 13, another embodiment of an oral care implement 300 will be described. The oral care implement 300 is similar to the oral care implement 200 described above with reference to FIGS. 6-11, and thus certain details of the oral care implement 300 will be omitted, it being understood that the description of the oral care implement 200 is applicable. Furthermore, features of the oral care implement 300 that are similar to features of the oral care implement 200 will be similarly numbered except that the 300-series of numbers will be used. For similarly numbered features, to the extent that a detailed description is not provided herein below, the description of the similar feature of the oral care implement 200 is applicable.

The oral care implement 300 generally comprises a handle 310 (only a minor portion of which is visible) and a head 320 that is coupled to the handle 310. The handle 310 and the head 320 may be made integrally or separately and later coupled together in a permanent or detachable manner. The head 320 has a front surface 321 and an opposite rear surface 322. The oral care implement 300 comprises a plurality of cleaning elements 330 extending from the front surface 321 of the head 320. In the exemplified embodiment, the head 320 comprises a base portion 325 and a head plate 327 similar to that which was described above with regard to the oral care implement 200. However, in other embodiments the head 320 may be a unitary structure without a head plate as is common in conventional toothbrushes.

The head 320 has a plurality of openings 328, sometimes referred to as tuft holes, formed therein for coupling the cleaning elements 330 to the head 320. When a head plate 327 is used, the openings 328 may extend entirely through the head plate 327 so that the cleaning elements 330 may be coupled to the head 320 using anchor-free tufting techniques as described in detail above. When a head plate is not used, the openings 328 may be holes that are open on one end and closed on the other so that the cleaning elements 330 may be coupled to the head 320 using staple technologies.

The cleaning elements 330 are arranged together into tufts 390 similar to that which has been described above. The tufts 390 extend from the front surface 321 of the head 320 along a longitudinal axis C-C. Furthermore, the cleaning elements 330 are preferably formed of an elastomeric material as has been described in detail above with regard to the cleaning elements 230. The material, size, diameter, other structural characteristics, and manufacturing technique of the cleaning elements 230 described above are applicable to the cleaning elements 330 of this embodiment. In fact, the only difference between this embodiment and the previously described embodiment is that the oral care implement 300 does not include sleeves as were disclosed above with regard to the oral care implement 200. Rather, as described below, the openings 328 provide the function of the sleeves by applying a compression force onto the cleaning elements 330 of each tuft 390 to create the flaring effect shown in the drawings and described above.

Specifically, each of the openings 328 is defined by an inner surface 335. The openings 328 may have any desired cross-sectional shape. The openings 328 have a diameter D5. In an uncompressed state, the tuft 390 is defined by a reference circle having a diameter D1 just as described above and shown in FIG. 8B. The diameter D1 of the uncompressed tuft 390 is greater than the diameter D5 of the openings 328. Thus, when the tuft 390 is inserted into one of the openings 328, the inner surface 335 of the opening 328 applies a radial compression force onto the tuft 390, thereby deforming a first portion 391 of the tuft 390 (and specifically the cleaning elements 330 thereof) that is located within the opening 328. Furthermore, a second portion 392 of the tuft 390 (and specifically the cleaning elements 330 thereof) that protrudes from the front surface 321 of the head 320 diverges from the axis C-C with increasing distance from the front surface 321 of the head 320.

Thus, the cleaning elements 330 of each tuft 390 splay or flare outwardly as they extend from the front surface 321 of the head 320 in a similar fashion to that which was described above with regard to the oral care implement 200. In this embodiment, the divergence of the cleaning elements 330 may be more gradual due to the omission of the sleeve. Specifically, a smaller portion of the length of the cleaning elements 330 will be compressed than when the sleeves are used, which results in a reduced and more gradual flaring of the cleaning elements 330. Nonetheless, the overall effect and benefits are the same as described above with regard to the oral care implement 200. In some embodiments, each tuft 390 may be inserted into a tuft hole that compresses a portion of the cleaning elements 330 and each tuft 390 may be surrounded by a sleeve that compresses a portion of the cleaning elements 330. Thus, the features illustrated and described with reference to the oral care implements 200, 300 may be combined in various ways in alternative embodiments.

Figure 14:
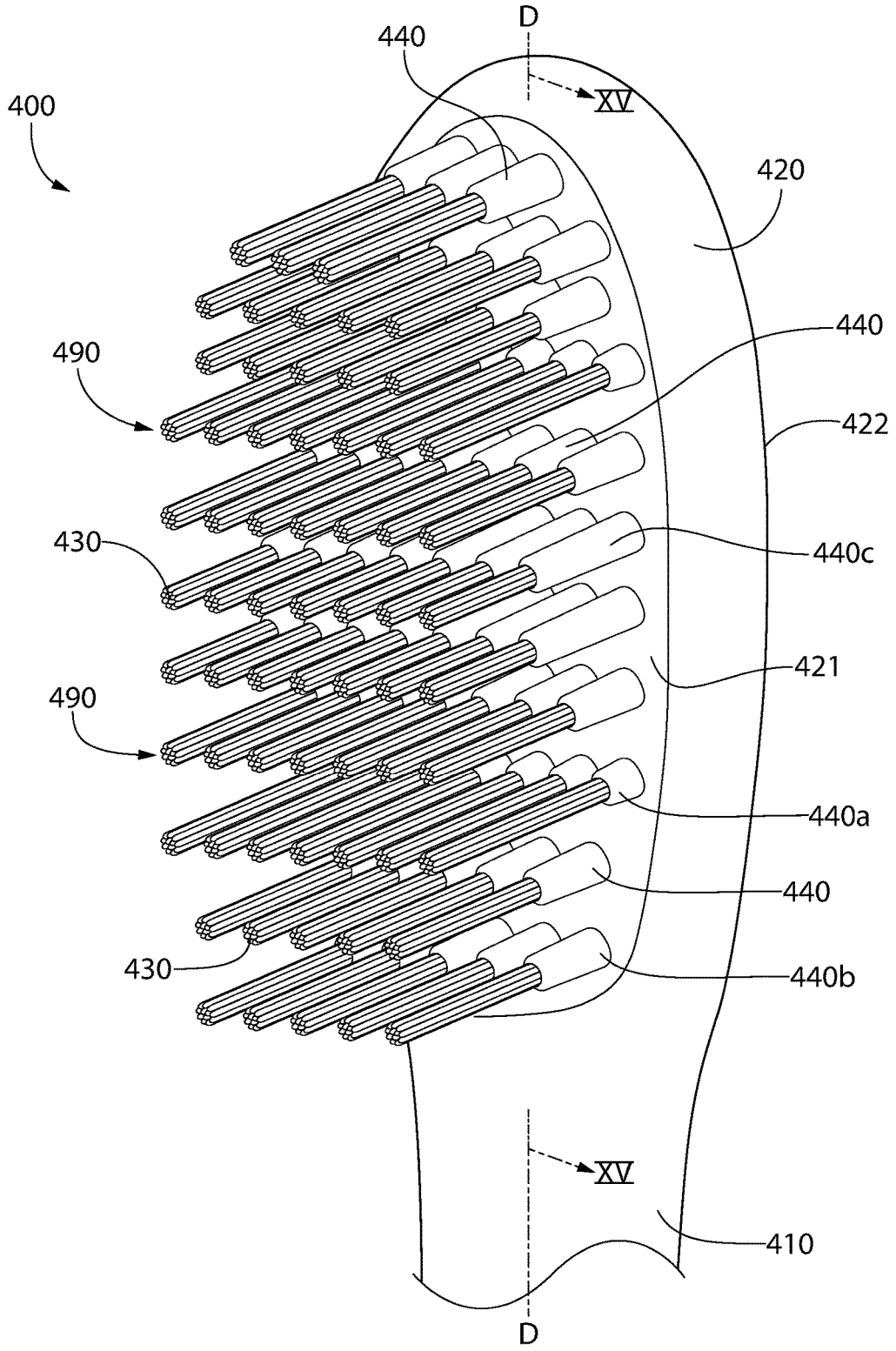
FIG. 14 is a close-up view of a head of an oral care implement in accordance with yet another embodiment of the present invention.
Figure 15:
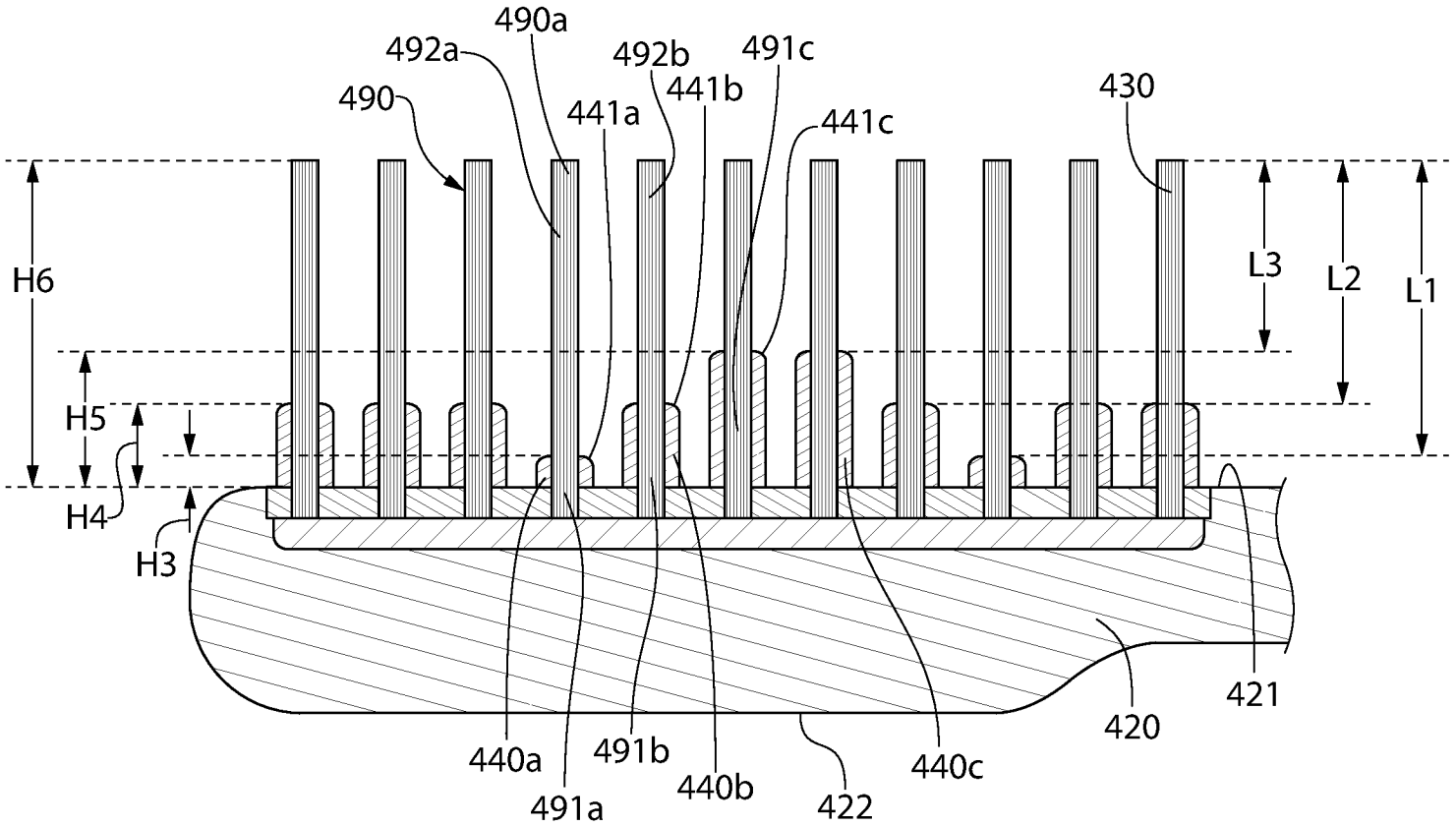
FIG. 15 is a cross-sectional view taken along line XV-XV of FIG. 14.

Referring to FIGS. 14 and 15, another embodiment of an oral care implement 400 will be described. The oral care implement 400 is similar to the oral care implement 200 described above with reference to FIGS. 6-11, and thus certain details of the oral care implement 400 will be omitted, it being understood that the description of the oral care implement 200 is applicable. Furthermore, features of the oral care implement 400 that are similar to features of the oral care implement 200 will be similarly numbered except that the 400-series of numbers will be used. For similarly numbered features, to the extent that a detailed description is not provided herein below, the description of the similar feature in the oral care implement 200 is applicable.

The oral care implement 400 comprises a handle 410 and a head 420 that is coupled to the handle 410. The head 420 has a front surface 421 and an opposite rear surface 422. A plurality of cleaning elements 430 are coupled to the head 420 and extend from the front surface 421 of the head 420. More specifically, the cleaning elements 430 are arranged together into tufts 490, each of which is inserted into a separate tuft hole in the front surface 421 of the head 420. Furthermore, similar to the oral care implement 200, the oral care implement 400 comprises a plurality of sleeves 440 extending from the front surface 421 of the head 420. Each of the sleeves 440 circumferentially surrounds one of the tufts 490 of the cleaning elements 430.

The structure, material of construction, dimensions, and the like of the cleaning elements 430 are the same as that which has been described above with reference to the cleaning elements 230. Furthermore, the structure, material of construction, dimensions, and the like of the sleeve 440 is the same as that which has been described above with reference to the sleeve 240 except for the differences specifically mentioned herein below. Specifically, the exemplified embodiment of the oral care implement 400 is identical to the oral care implement 200 except that in this embodiment the sleeves 440 have varying heights rather than each sleeve 440 having the same height. In that regard, the sleeves 440 include a first sleeve 440*a* having a height H3 measured from the front surface 421 of the head 420 to a distal end 441*a* of the first sleeve 440*a*, a second sleeve 440*b* having a height H4 measured from the front surface 421 of the head 420 to a distal end 441*b* of the second sleeve 440*b*, and a third sleeve 440*c* having a height H5 measured from the front surface 421 of the head 420 to a distal end 441*c* of the third sleeve 440*c*. In this embodiment, the heights H3, H4, H5 of the first, second, and third sleeves 440*a-c* are different. Specifically, in this embodiment the height H5 of the third sleeve 440*c* is greater than the height H4 of the second sleeve 440*b*, and the height H4 of the second sleeve 440*b* is greater than the height H3 of the first sleeve 440*a*.

In one embodiment, each of the first, second, and third sleeves 440*a-c* may be formed of an elastomeric material. Furthermore, each of the first, second, and third sleeves 440*a-c* may have be formed of a different elastomeric material having a different hardness from one another. Alternatively, the first, second, and third sleeves 440*a-c* may be formed of the same elastomeric material having the same hardness.

In this embodiment, the first sleeve 440*a* circumferentially surrounds a first portion 491*a* of a first tuft 490*a* while a second portion 492*a* of the first tuft 490*a* protrudes from the distal end 441*a* of the first sleeve 440*a*. The second sleeve 440*b* circumferentially surrounds a first portion 491*b* of a second tuft 490*b* while a second portion 492*b* of the second tuft 490*b* protrudes from the distal end 441*b* of the second sleeve 440*b*. The third sleeve 440*c* circumferentially surrounds a first portion 491*c* of a third tuft 490*c* while a second portion 492*c* of the third tuft 490*c* protrudes from the distal end 441*c* of the third sleeve 440*c*.

Furthermore, in this embodiment each of the first, second, and third tufts 490*a-c* extend the same height H6 from the front surface 421 of the head 420 to the distal ends of the tufts 490*a-c*. As a result, the second portion 492*a* of the first tuft 490*a* measured from the distal end 441*a* of the first sleeve 440*a* to a distal end of the first tuft 490*a* has a first length L1. The second portion 492*b* of the second tuft 490*b* measured from the distal end 441*b* of the second sleeve 440*b* to a distal end of the second tuft 490*b* has a second length L2. The second portion 492*c* of the third tuft 490*c* measured from the distal end 441*c* of the third sleeve 440*c* to a distal end of the third tuft 490*c* has a third length L3. The first length L1 is greater than the second length L2 and the second length L2 is greater than the third length L3.

In the exemplified embodiment, the different lengths L1, L2, L3 are achieved due to the variation in the heights H3, H4, H5 of the sleeves 440*a-c*. Of course, the invention is not to be so limited in all embodiments. Specifically, in an alternative embodiment each of the sleeves 440*a-c* may have the same height, and the tufts 490*a-c* circumferentially surrounded by the sleeves 440*a-c* may be different heights. Where the heights of the sleeves 440*a-c* are the same, a taller tuft 490*a-c* will have a greater length L1, L2, L3 than a shorter tuft 490*a-c*. Both the height of the sleeves 440*a-c* and the length of the tufts 490*a-c* may be adjusted to achieve a desirable tuft stiffness and mouth feel during use.

The difference in the lengths L1, L2, L3 is important because it affects the overall stiffness of the tufts 490*a-c*. Specifically, the third tuft 490*c*, which has the shortest length protruding beyond the sleeve 440*c*, will be the most stiff and the first tuft 490*a*, which has the longest length protruding beyond the sleeve 440*a*, will be the least stiff, with the third tuft 490*b* falling somewhere in between. Thus, even though the tufts 490*a-c* all have the same overall length/height H6 measured from the front surface 421 of the head 420 to the distal end of the tufts 490*a-c*, the stiffness of the tufts 490*a-c* is controlled by adjusting the height of the sleeves 440*a-c* that surrounds the tufts 490*a-c*.

In some embodiments, the cleaning elements 430 may be formed of an elastomeric material as described herein above with reference to the cleaning elements 230. In such embodiments, the description regarding the flaring/diverging of the tufts is applicable. Thus, the tuft holes and/or the sleeves 440*a-c* may apply a compression force onto the first portions 491*a-c* of the tufts 490*a-c* that causes the second portions 492*a-c* of the tufts 490*a-c* to diverge from the axis of the tuft 490*a-c* with distance from the distal end 441*a-c* of the sleeve 440*a-c*. However, this is not required in all embodiments for the oral care implement 400. Specifically, in the oral care implement 400 the cleaning elements 430 may also be more conventional filament bristles such as those formed from polyamide or polyester. The main concept of this embodiment is that the sleeves 440 that circumferentially surround portions of the tufts 490 have a height variation. This could include sleeves 440 of two different heights, of three different heights as shown in the exemplified embodiment, or even sleeves 440 having more than three different heights. This is a simple way to adjust the stiffness of the tufts on the oral care implement 400 without changing the overall height of the tufts/cleaning elements.

In the exemplified embodiment, the tufts 490 are arranged on the head 420 in a plurality of rows that are transverse to a longitudinal axis D-D of the head 420. Each row has a plurality of the tufts 490 and each of the tufts 490 within one row is surrounded by one of the first sleeves 440*a*, one of the second sleeves 440*b*, or one of the third sleeves 440*c* (only one of the first, second, and third sleeves 440*a-c* is used in each row). Thus, in this embodiment the stiffness of the tufts 490 will change along the longitudinal direction of the head 420. Of course, this is just one implementation of this concept. In another embodiment, the head 420 may include a cleaning element field having peripheral tufts of cleaning elements located along the outer bounds of the cleaning element field and central tufts of cleaning elements that are surrounded by the peripheral tufts of cleaning elements. In such an embodiment, each of the peripheral tufts may be surrounded by a first sleeve having a first height and each of the central tufts may be surrounded by a second sleeve having a second height that is different than the first height. Countless variations to this are possible depending on the specific stiffness of the specific areas of the head that are desired.

In the various embodiments disclosed herein, the sleeves 240, 440 are depicted having a substantially constant and identical thickness/width. The invention is not to be so limited in all embodiments and the thickness, material, and the like of the sleeves 240, 440 may be modified in some embodiments along with the modification of the height of the sleeves 440 as described above.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a handle;

a head coupled to the handle and having a front surface;

a first tuft of cleaning elements extending from the front surface of the head along an axis and comprising a first plurality of cleaning elements formed of an elastomeric material;

a second tuft of cleaning elements extending from the front surface of the head and comprising a second plurality of cleaning elements formed of the elastomeric material;

a first sleeve coupled to the head and extending from the front surface of the head, the first sleeve circumferentially surrounding a first portion of the tuft of cleaning elements, a second portion of the tuft of cleaning elements protruding beyond a distal end of the sleeve, and the first sleeve having a first height measured from the front surface of the head to a distal end of the first sleeve; and a second sleeve coupled to the head and extending from the front surface of the head, the second sleeve circumferentially surrounding a portion of the second tuft of cleaning elements, the second sleeve having a second height measured from the front surface of the head to a distal end of the second sleeve;

wherein the first and second heights are different when the first and second tufts of cleaning elements are in a resting state with no external forces applied.

2. The oral care implement according to claim 1 wherein the first sleeve applies a radial compression force onto the first portion of the first tuft of cleaning elements thereby causing the second portion of the first tuft of cleaning elements to diverge from the axis with increasing distance from the distal end of the first sleeve.

3. The oral care implement according to claim 2 wherein the first tuft of cleaning elements in an uncompressed state is defined by a reference circle having a first diameter, and wherein the first sleeve has an inner surface that defines a passageway within which the first tuft of cleaning elements are disposed, the passageway having a second diameter that is less than the first diameter of the reference circle of the first tuft of cleaning elements.

4. The oral care implement according to claim 2 wherein the first tuft of cleaning elements in an uncompressed state is defined by a reference circle having a first diameter, and when circumferentially surrounded by the first sleeve, has a second diameter at the distal end of the first sleeve and a third diameter at a distal end of the first tuft of cleaning elements, and wherein the third diameter of the first tuft of cleaning elements is greater than the second diameter of the first tuft of cleaning elements.

5. The oral care implement according to claim 1 wherein the first sleeve is formed of an elastomeric material.

6. The oral care implement according to claim 1 wherein the first plurality of cleaning elements are extruded from the elastomeric material, and wherein each of the first plurality of cleaning elements has an outer diameter between 0.25 mm and 1.0 mm.

7. The oral care implement according to claim 1 wherein the first plurality of cleaning elements extend a third height from the front surface of the head, the third height being at least twice the first height of the first sleeve.

8. An oral care implement comprising:

a handle;

a head coupled to the handle and having a front surface, at least one tuft hole formed into the front surface;

a first tuft of cleaning elements having a first portion positioned within the tuft hole and a second portion extending from the front surface of the head along an axis, the tuft of cleaning elements comprising a first plurality of cleaning elements formed of an elastomeric material; and a second tuft of cleaning elements extending from the front surface of the head and comprising a second plurality of cleaning elements;

a first sleeve extending from the front surface of the head and surrounding the first tuft of cleaning elements, the first sleeve having a first height measured from the front surface of the head to a distal end of the first sleeve; and a second sleeve extending from the front surface of the head and surrounding the second tuft: of cleaning elements, the second sleeve having a second height measured from the front surface of the head to a distal end of the second sleeve;

wherein the tuft hole applies a radial compression force onto the first portion of the first tuft of cleaning elements thereby causing the second portion of the first tuft of cleaning elements to diverge from the axis with increasing distance from the front surface of the head; and wherein the first and second heights are different when the first and second tufts of cleaning elements are in a resting state with no external forces applied.

9. The oral care implement according to claim 8 wherein the tuft hole has a first diameter and the first tuft of cleaning elements has a second diameter in an uncompressed state, the second diameter being greater than the first diameter.

10. The oral care implement according to claim 8 wherein the first plurality of cleaning elements are extruded from the elastomeric material and each of the plurality of cleaning elements has an outer diameter between 0.25 mm and 1.0 mm.

11. An oral care implement comprising:

a handle;

a head coupled to the handle and having a front surface;

a first tuft of cleaning elements extending from the front surface of the head along a first axis and comprising a first plurality of cleaning elements;

a second tuft of cleaning elements extending from the front surface of the head along a second axis and comprising a second plurality of cleaning elements;

a first sleeve coupled to the head and extending from the front surface of the head, the first sleeve circumferentially surrounding a portion of the first tuft of cleaning elements, the first sleeve having a first height measured from the front surface of the head to a distal end of the first sleeve;

a second sleeve coupled to the head and extending from the front surface of the head, the second sleeve circumferentially surrounding a portion of the second tuft of cleaning elements, the second sleeve having a second height measured from the front surface of the head to a distal end of the second sleeve; and wherein the first and second heights are different when the first and second tufts of cleaning elements are in a resting state with no external forces applied.

12. The oral care implement according to claim 11 wherein the first and second plurality of cleaning elements are each formed of an elastomeric material, and wherein the first and second plurality of cleaning elements each has a diameter between 0.25 nun and 1.0 mm.

13. The oral care implement according to claim 11 wherein the first sleeve circumferentially surrounds a first portion of the first tuft of cleaning elements and a second portion of the first tuft of cleaning elements protrudes beyond the distal end of the first sleeve, and wherein the second sleeve circumferentially surrounding a first portion of the second tuft of cleaning elements and a second portion of the second tuft of cleaning elements protrudes beyond the distal end of the second sleeve.

14. The oral care implement according to claim 13 wherein the first sleeve applies a radial compression force onto the first portion of the first tuft of cleaning elements so that the second portion of the first tuft of cleaning elements diverge from the first axis with increasing distance from the distal end of the first sleeve, and wherein the second sleeve applies a radial compression force onto the first portion of the second tuft of cleaning elements so that the second portion of the second tuft of cleaning elements diverge from the second axis with increasing distance from the distal end of the second sleeve.

15. The oral care implement according to claim 11 wherein the first tuft of cleaning elements has a third height measured from the front surface of the head to a distal end of the first tuft of cleaning elements and the second tuft of cleaning elements has a fourth height measured from the front surface of the head to a distal end of the second tuft of cleaning elements, wherein a ratio of the third height to the first height is different than a ratio of the fourth height to the second height.

16. The oral care implement according to claim 11 wherein the head comprises a cleaning element field comprising a plurality of the first tufts of cleaning elements each surrounded by one of the first sleeves and positioned along a periphery of the cleaning elements field and a plurality of the second tufts of cleaning elements each surrounded by one of the second sleeves and positioned centrally in the cleaning elements field.

17. The oral care implement according to claim 16 wherein the first heights of the first sleeves are greater than the second heights of the second sleeves.

18. The oral care implement according to claim 16 wherein the head extends along a longitudinal axis and comprises a plurality of the first tufts of cleaning elements arranged in rows extending transverse to the longitudinal axis and a plurality of the second tufts of cleaning elements arranged in rows extending transverse to the longitudinal axis, each of the first, tufts of cleaning elements surrounded by one of the first sleeves and each of the second tufts of cleaning elements surrounded by one of the second sleeves.

19. The oral care implement according to claim 11 wherein the first sleeve is formed of a first elastomeric material having a first hardness and the second sleeve is formed of a second elastomeric material having a second hardness, the first and second hardnesses being different.

20. An oral care implement comprising:

a handle:

a head coupled to the handle and having a front surface;

a first tuft of cleaning elements extending from the front surface of the head along a first axis and comprising a first plurality of cleaning elements;

a second tuft of cleaning elements extending from the front surface of the head along a second axis and comprising a second plurality of cleaning elements;

a first sleeve coupled to the head and extending from the front surface of the head, the first sleeve circumferentially surrounding a portion of the first tuft of cleaning elements, the first sleeve having a first height measured from the front surface of the head to a distal end of the first sleeve; and a second sleeve coupled to the head and extending from the front surface of the head, the second sleeve circumferentially surrounding a portion of the second tuft of cleaning elements, the second sleeve having a second height measured from the front surface of the head to a distal end of the second sleeve;

wherein the first and second heights are different; and wherein the first tuft of cleaning elements has a third height measured from the front surface of the head to a distal end of the first tuft of cleaning elements and the second tuft of cleaning elements has a fourth height measured from the front surface of the head to a distal end of the second tuft of cleaning elements, the third and fourth heights being the same.

* * * * *